US011387066B2

(12) United States Patent
Hanna et al.

(10) Patent No.: US 11,387,066 B2
(45) Date of Patent: Jul. 12, 2022

(54) CUTOUT MOUNTED RECLOSER

(71) Applicant: ABB Schweiz AG, Baden (CH)

(72) Inventors: Robert L Hanna, Enterprise, FL (US); Patrick R. Fischer-Carne, New Smyrna Beach, FL (US); Luciano A. Di Maio, Milan (IT)

(73) Assignee: ABB SCHWEIZ AG, Baden (CH)

( * ) Notice: Subject to any disclaimer, the term of this patent is extended or adjusted under 35 U.S.C. 154(b) by 7 days.

(21) Appl. No.: 16/915,061

(22) Filed: Jun. 29, 2020

(65) Prior Publication Data

US 2020/0328054 A1 Oct. 15, 2020

Related U.S. Application Data

(63) Continuation of application No. PCT/US2018/067507, filed on Dec. 26, 2018.

(60) Provisional application No. 62/611,716, filed on Dec. 29, 2017.

(51) Int. Cl.

| | |
|---|---|
| ***H01H 33/42*** | (2006.01) |
| ***H01H 50/14*** | (2006.01) |
| ***H01H 50/64*** | (2006.01) |
| ***H01H 71/24*** | (2006.01) |

(52) U.S. Cl.

CPC ..... *H01H 71/24* (2013.01); *H01H 33/42* (2013.01); *H01H 50/14* (2013.01); *H01H 50/641* (2013.01)

(58) Field of Classification Search

CPC ..... H01H 33/42; H01H 33/125; H01H 33/14; H01H 33/6662; H01H 33/6606; H01H 50/14; H01H 50/641; H01H 50/54; H01H 71/24; H01H 71/2454; H01H 75/04; H01H 1/0015; H01H 9/0038; H02H 3/20

USPC ..... 218/154, 9, 10, 12, 43, 4–7, 14, 19, 42, 218/45, 79, 80, 100, 101; 335/9; 337/171

See application file for complete search history.

(56) References Cited

U.S. PATENT DOCUMENTS 4,321,575 A 3/1982 Koszewa et al.
4,795,996 A * 1/1989 Brown ..... H01H 31/127 337/169

(Continued)

OTHER PUBLICATIONS

International Search Report and Written Opinion, issued by the ISA/US United States Receiving Office, regarding corresponding patent application Serial No. PCT/US2018/067507; dated Mar. 22, 2019; 10 pages.

*Primary Examiner* — William A Bolton
(74) *Attorney, Agent, or Firm* — Greenberg Traurig, LLP

(57) ABSTRACT

A cutout mountable recloser that remains latched to the cutout until the recloser is selectively mechanically unlatched via at least rotation of a driver by an operator. During installation, including while the recloser is being latched to the cutout, the recloser can be in an open condition. Latching of the recloser to the cutout can include increasing a tension force exerted by the cutout on the recloser by increasing a linear distance between first and second terminals of the recloser. With the opened recloser latched to the cutout, the recloser can be mechanically closed via a release of stored energy from a closing mechanism. The recloser can selectively be mechanically unlatched from the cutout by a subsequent reduction in the linear distance between first and second terminals of the recloser, which can reduce the tension force being exerted by the cutout.

22 Claims, 27 Drawing Sheets

(56) References Cited

U.S. PATENT DOCUMENTS

| | | | | |
|---|---|---|---|---|
| 5,854,582 | A * | 12/1998 | Clark | H01H 31/28 337/169 |
| 6,392,526 | B1 * | 5/2002 | Roberts | H01H 31/127 337/178 |
| 6,687,110 | B2 * | 2/2004 | Murray | H01H 33/6661 361/131 |
| 7,948,352 | B2 * | 5/2011 | Tang | H01H 31/127 337/171 |
| 8,334,738 | B2 * | 12/2012 | Smith | H01H 75/04 335/18 |
| 8,772,633 | B2 * | 7/2014 | Behnken | H01B 19/00 174/5 R |
| 2004/0144756 | A1 | 7/2004 | Rhein et al. | |
| 2009/0212898 | A1 * | 8/2009 | Montante | H01H 31/02 337/171 |
| 2010/0230263 | A1 | 9/2010 | Haj-Maharsi | |
| 2015/0116878 | A1 * | 4/2015 | Richard | H01H 9/0038 361/71 |

* cited by examiner

CUTOUT MOUNTED RECLOSER

BACKGROUND

Embodiments of the present application generally relate to recloser devices for power distribution systems. More particularly, but not exclusively, embodiments of the present application relate to reclosers that are latchable to cutouts in an open condition, and which in the absence of selective mechanical unlatching remain latched to the cutout regardless of the open or closed condition of the recloser or its operational state or history.

Fuse cutouts, or simply cutouts, are used to protect against electrical overload in power distribution systems. Traditional cutout designs often employ a high voltage dropout fuse and a mounting insulator that electrically isolates conductive portions of the cutout from the support to which the cutout is mounted. Often, an end of the dropout fuse is pivotally attached to the cutout, while the other end of the dropout fuse is configured to be releasable from the cutout upon the occurrence of certain electrical events, such as, for example, in response to at least certain fault currents. For example, in response to certain fault currents, an end of the dropout fuse can be melted such the melted end becomes detached from the cutout. The dropout fuse can then, under at least the force of gravity and/or the weight of the fuse, pivoted away from the cutout about the end of the fuse that remains pivotally coupled to the cutout. Such release of a portion of the dropout fuse from the cutout in direct response to the fault current can result in the fuse being moved to a visibly detectable drop position relative to at least the cutout at which only pivotally connected end of the dropout fuse remains connected to the cutout.

Rather than a dropout fuse, certain cutouts can employ a recloser that, via operation of an electromagnetic actuator, seeks to automatically reclose an open circuit. However, operation of an electromagnet actuator typically is dependent on the electromagnetic actuator receiving a supply of electrical energy. Yet, at least in certain situations, the recloser and associated electronics can cease to receive a supply of primary electrical power for relatively prolonged periods of time. Such unavailability of primary power can result in a depletion of stored electrical power for operation of the recloser. Accordingly, the stored electrical power, if any, can become insufficient to effectuate operation of the recloser, which can result in the recloser remaining in the open position.

BRIEF SUMMARY

An aspect of an embodiment of the present application is a cutout mountable recloser that includes a first terminal and a recloser assembly, the recloser assembly being electrically coupled to the first terminal. The recloser assembly can include a current interrupter, an electromagnetic actuator, and a pushrod. The recloser can further include a latch system that is coupled to the recloser assembly. The latch system can comprise a lower terminal latch plate that is pivotally displaceable between a first, raised position and a second, lowered position. The recloser can also include a second terminal that is electrically coupled to the recloser assembly, and which is coupled to the lower terminal latch plate. The second terminal can be pivotally displaceable between a raised position and a lowered position by the pivotable displacement of the lower terminal latch plate between the first, raised position and the second, lowered position. Additionally, the second terminal can be separated from the first terminal by a first linear distance when the second terminal is in the raised position, and by a second linear distance when the second terminal is in the lowered position, the first linear distance being smaller than the second linear distance.

Another aspect of an embodiment of the present application is a recloser that is structured for a selectively releasable latching engagement with a cutout. The recloser can include a driver, a first terminal, and a recloser assembly, the recloser assembly being electrically coupled to the first terminal and coupled to the driver. The recloser assembly can include a current interrupter, a pushrod, an electromagnetic actuator, and a closing mechanism. The closing mechanism can have at least one closer body and at least one mechanical biasing element. The at least one mechanical biasing element can release a force, when the closing mechanism is discharged from a charged state to a discharged state, that displaces the at least one closer body into a moving engagement with the pushrod. The moving engagement between the at least one closer body and the pushrod can displace the pushrod to a position that electrically closes the current interrupter. The recloser can also include a latch system that is coupled to the driver. The latch system can have a lower terminal latch plate that is pivotally displaceable in between a first, raised position and a second, lowered position. Additionally, the recloser can include a second terminal that can be coupled to the lower terminal latch plate and electrically coupled to at least the recloser assembly. The second terminal can be pivotally displaceable between a raised position and a lowered position by the pivotable displacement of the lower terminal latch plate between the first, raised position and the second, lowered position.

Another aspect of an embodiment of the present application is a method that includes rotably coupling a second terminal of a recloser to a lower hinge support of a cutout, the recloser including an electromagnetic actuator. A first terminal of the recloser can then be rotably displaced into engagement with an upper contact of an upper mounting bracket of the cutout. The recloser can be latched to the cutout by selectively increasing a linear distance between the first terminal and the second terminal via at least rotation of a driver of the recloser in a first rotational direction. Each of the preceding steps can, for example, be performed while the recloser is in an electrically opened condition. Moreover, according to certain embodiments, the recloser may not be closed until after the recloser has been latched to the cutout. Further, the recloser can be unlatched from the cutout by selectively decreasing the linear distance between the first terminal and the second terminal via at least rotation of the driver in a second rotational direction. Additionally, after unlatching the recloser, the first terminal can be rotably displaced from the upper contact.

BRIEF DESCRIPTION OF THE DRAWINGS

The description herein makes reference to the accompanying figures wherein like reference numerals refer to like parts throughout the several views.

Figure 1:
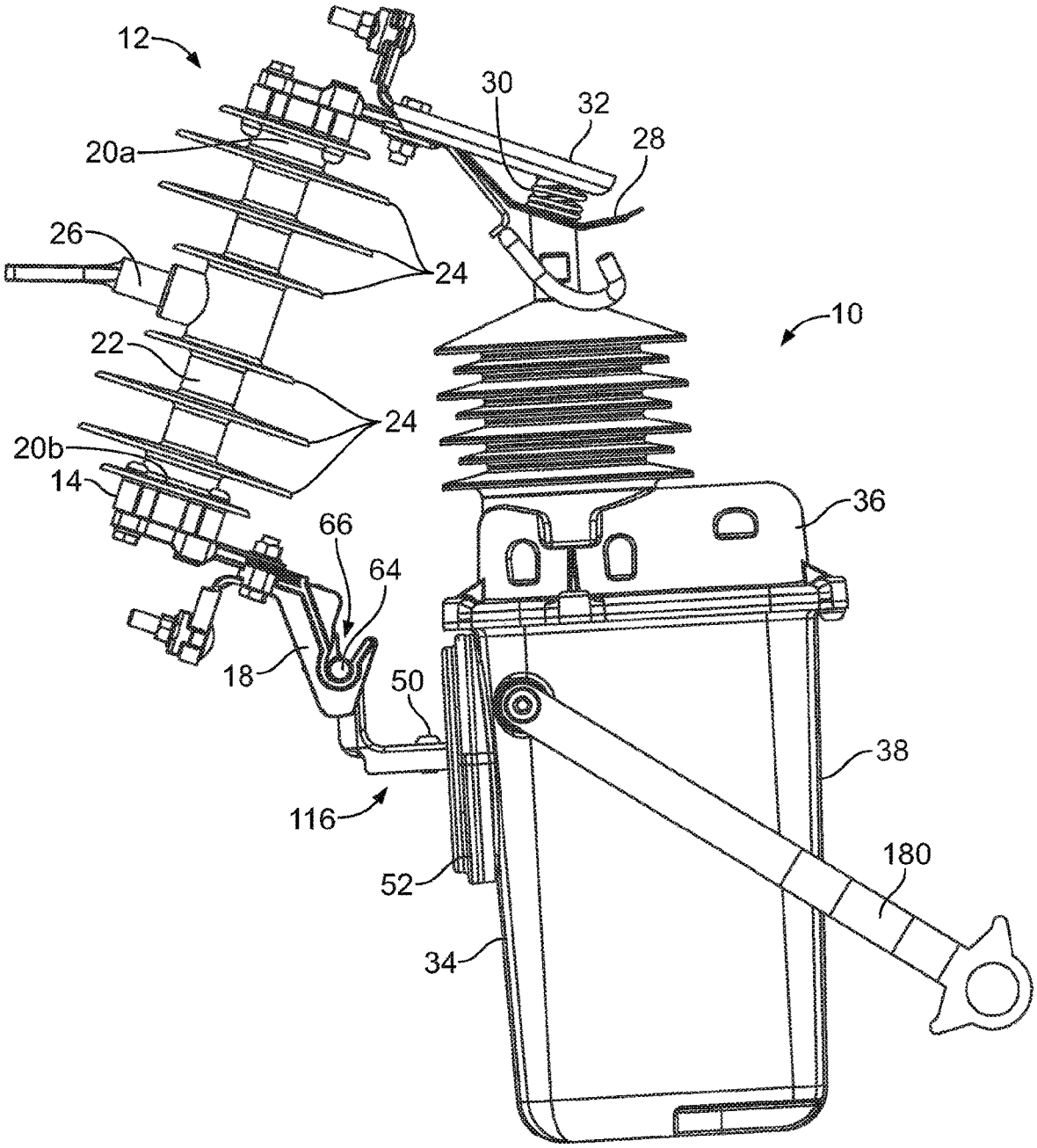
FIG. 1 illustrates a side view of a cutout mountable recloser latched to a cutout according to an exemplary embodiment of the present application.
Figure 2:
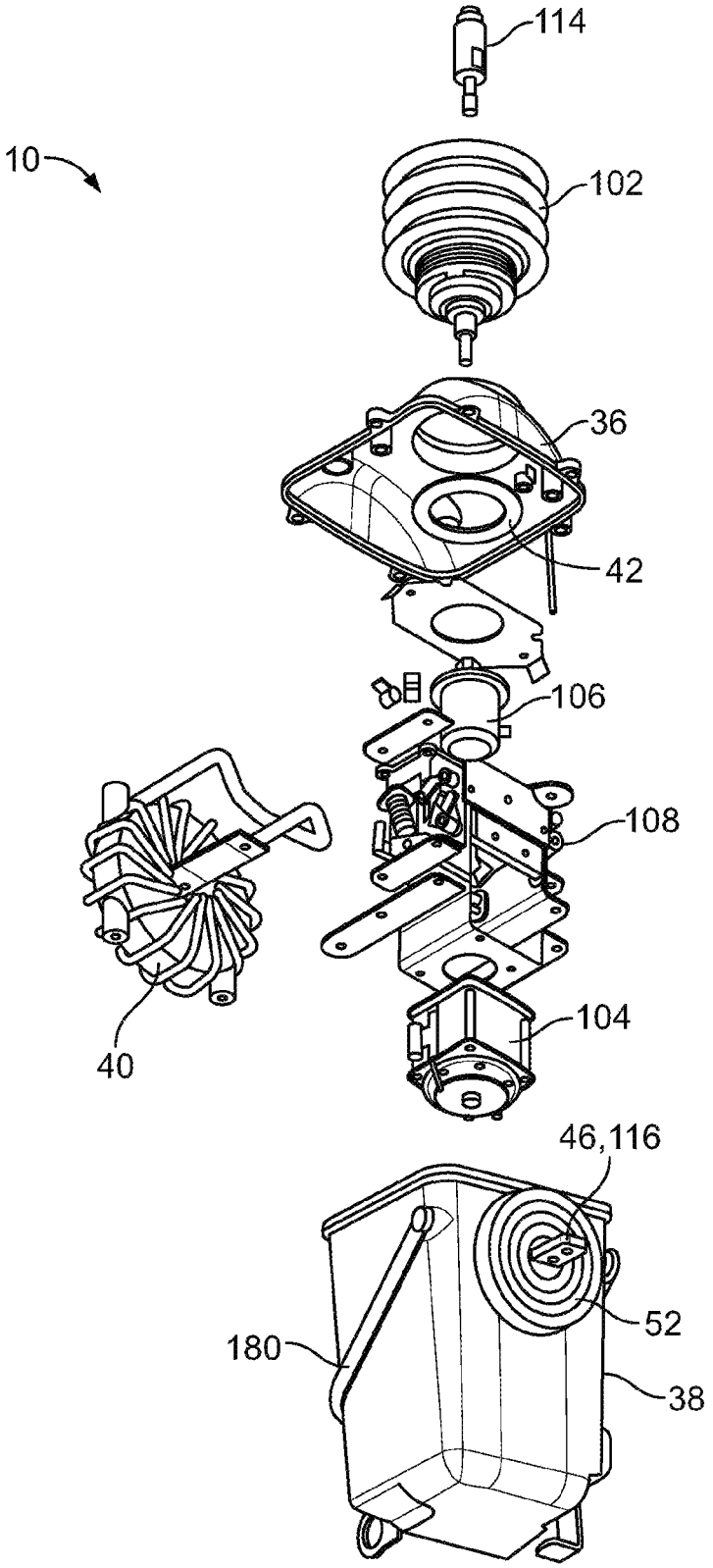
FIG. 2 illustrates an exploded view of an exemplary cutout mountable recloser according to an exemplary embodiment of the present application.

The foregoing summary, as well as the following detailed description of certain embodiments of the present application, will be better understood when read in conjunction with the appended drawings. For the purpose of illustrating the application, there is shown in the drawings, certain embodiments. It should be understood, however, that the present application is not limited to the arrangements and instrumentalities shown in the attached drawings. Further, like numbers in the respective figures indicate like or comparable parts.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIG. 1 illustrates a side view of a cutout mountable recloser 10 latched to a cutout 12 according to an exemplary embodiment of the present application. The cutout 12 can, for example, be used for overhead power distribution systems. According to the illustrated embodiment, the cutout 12 includes a support bracket 14 having an upper mounting bracket 16 and a lower hinge support 18 that are coupled to opposing ends of 20*a*, 20*b* of an insulating rod 22 of the cutout 12. Thus, according to certain embodiments, the cutout 12 can generally have a "C" shape. The insulating rod 22 can include an insulating core, such as, for example, a core constructed from a fiberglass or glass-reinforced epoxy tube, among other insulating materials, that can be coupled to insulating sheds 24, as well as an elbow 26.

As discussed below, the upper mounting bracket 16 and the lower hinge support 18 are configured to at least accommodate selective latching, as well as selective unlatching, of the recloser 10 to/from the cutout 12. Additionally, the upper mounting bracket 16 and the lower hinge support 18 are configured to be electrically coupled to the recloser 10. According to the illustrated embodiment, the upper mounting bracket 16 includes an upper contact 28, a contact spring 30, and an upper support plate 32. The upper contact 28, which is coupled to the upper support plate 32, can constructed to provide an electrical contact through which primary power can be delivered to the recloser 10. The contact spring 30 can, at least when the recloser 10 is latched to the cutout 12, provide a tension force that can at least assist in retaining the recloser 10 latched to the cutout 12. The lower hinge support 18 can be configured to accommodate selective rotation of the recloser 10 relative to the cutout 12, such as, for example, rotation associated with an operator displacing the recloser 10 into at least engagement with the cutout 12 at an orientation that can accommodate subsequent latching of the recloser 10 to the cutout 12, as shown in at least FIG. 1 and discussed below. Further, when the recloser 10 is selectively mechanically unlatched from the cutout 12, the lower hinge support 18 can accommodate the operator rotating the recloser 10 to the unlatched position. Additionally, at least a portion of the lower hinge support 18 can be configured to receive primary power, if any, that has flowed through the recloser 10.

According to the illustrated embodiment, the cutout 12 is mounted to an associated structure, such as, for example, a utility pole or tower, among other structures, at an orientation that can assist with the selective downward rotational displacement, or a drop, of the recloser 10 from the cutout in response to an operator or other individual electing to mechanically unlatch the recloser 10 from the cutout 12. For example, according to certain embodiments, the cutout 12 can be mounted at an acute angle relative to a corresponding ground surface such that the upper mounting bracket 16 and the lower hinge support 18 can generally outwardly extend from the insulating rod 22 in a downwardly sloping direction. Moreover, according to certain embodiments, the cutout 12 can be angularly offset in the vertical direction in a manner that can utilize at least gravitational forces and/or the weight of the recloser 10 to pivotally displace, or drop, the recloser 10 about the lower hinge support 18 after the recloser 10 has been selectively mechanically unlatched from the cutout 12 by an operator or individual.

Figure 6:
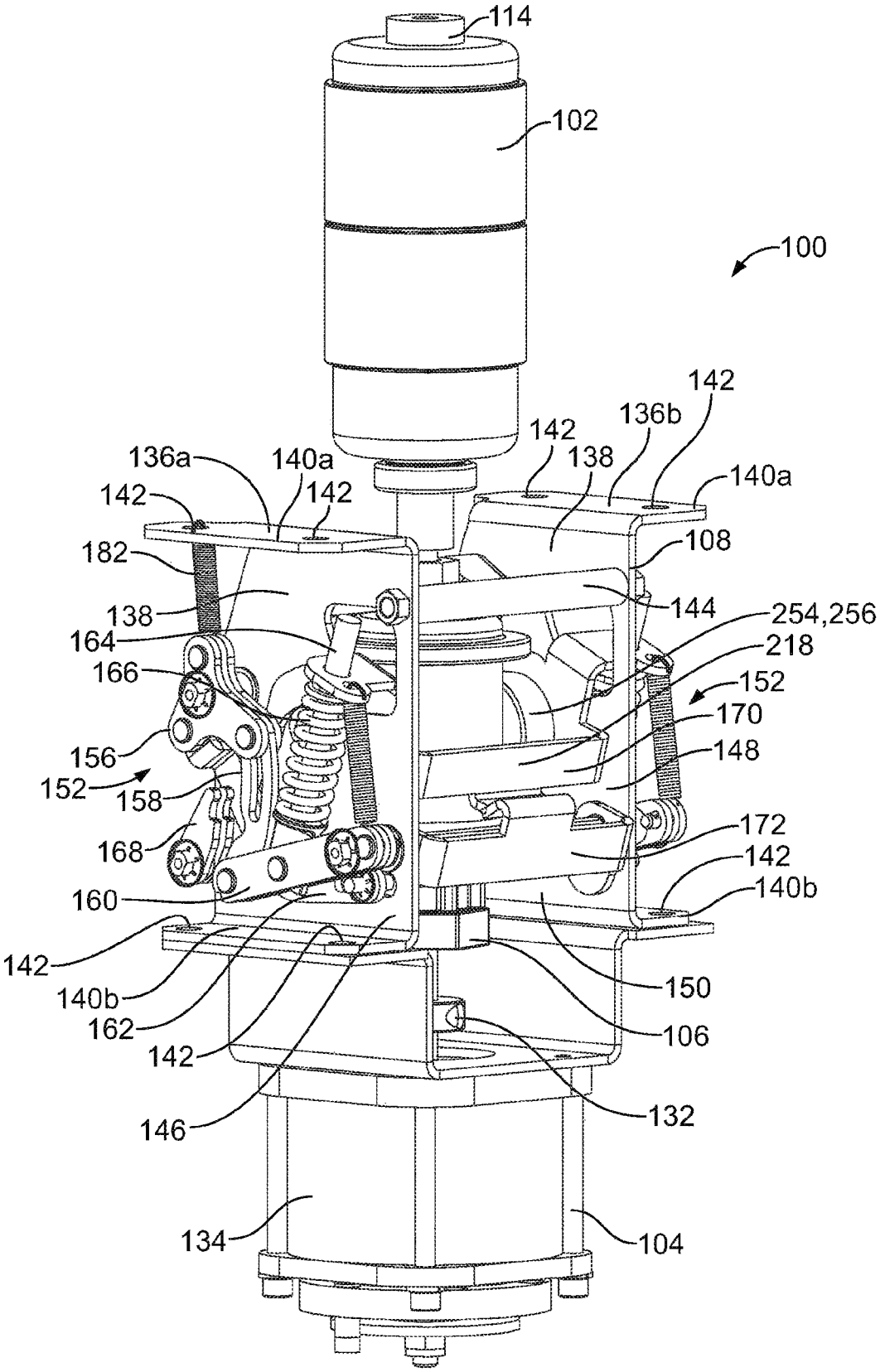
FIG. 6 illustrates a front side perspective view of a recloser assembly according to an exemplary embodiment of the present application.

Referencing FIGS. 1-6, the recloser 10 can include a housing 34 comprising an upper housing portion 36 and a lower housing portion 38. Additionally, the housing 34 can generally define an interior space to house at least certain components of the recloser 10, including, for example, at least portions of a recloser assembly 100 (FIG. 6). For example, the recloser assembly 100 can include a current interrupter 102, an electromagnetic actuator 104, a pushrod 106, and a closing mechanism 108. As shown by at least FIGS. 2 and 3, the recloser 10 can further include a current transformer 40, a current sensor 42, a driver 180, and associated electronics 44. The electronics 44 can at least assist with the operation of the recloser 10 and/or the electromagnetic actuator 104, and can include, for example a microprocessor and one or more energy storage devices, such as, for example, one or more capacitors or batteries, among other devices. As discussed below, during at least certain situations, the energy storage device can supply, if available, an electrical current that can be used for operation of the electromagnetic actuator 104. The driver 180, such as, for example, a handle, can be rotably coupled to the housing 34 and/or one or more portions of the recloser assembly 100, as discussed below.

Additionally, the recloser 10 can also include a first, upper terminal 114 (H1 terminal) that is configured to securely engage the upper mounting bracket 16 when the recloser 10 is latched to the cutout 12. Moreover, the first terminal 114 is configured to be electrically coupled to the upper contact 28 of the upper mounting bracket 16 of the cutout 12 at least when the recloser 10 is latched to the cutout 12 such that primary power can be received by the recloser 10 at the first terminal 114. Additionally, as discussed below, the recloser 10 is configured to remain latched to the cutout 12 in the event the recloser 10 is in an open position such that the first terminal 114 remains at least in contact with the upper contact 28 of the upper mounting bracket 16 of the cutout 12. For example, as discussed below, in the event the recloser 10 is opened, including, for example, when the electromagnetic actuator 104 has locked the recloser 10 in the open position, the recloser can remain latched to the cutout 12, as shown, for example, in FIG. 1, until the recloser 10 is selectively moved or dropped to the unlatched position by the actions of an operator or technician, among other workers or individuals.

Figure 4A:
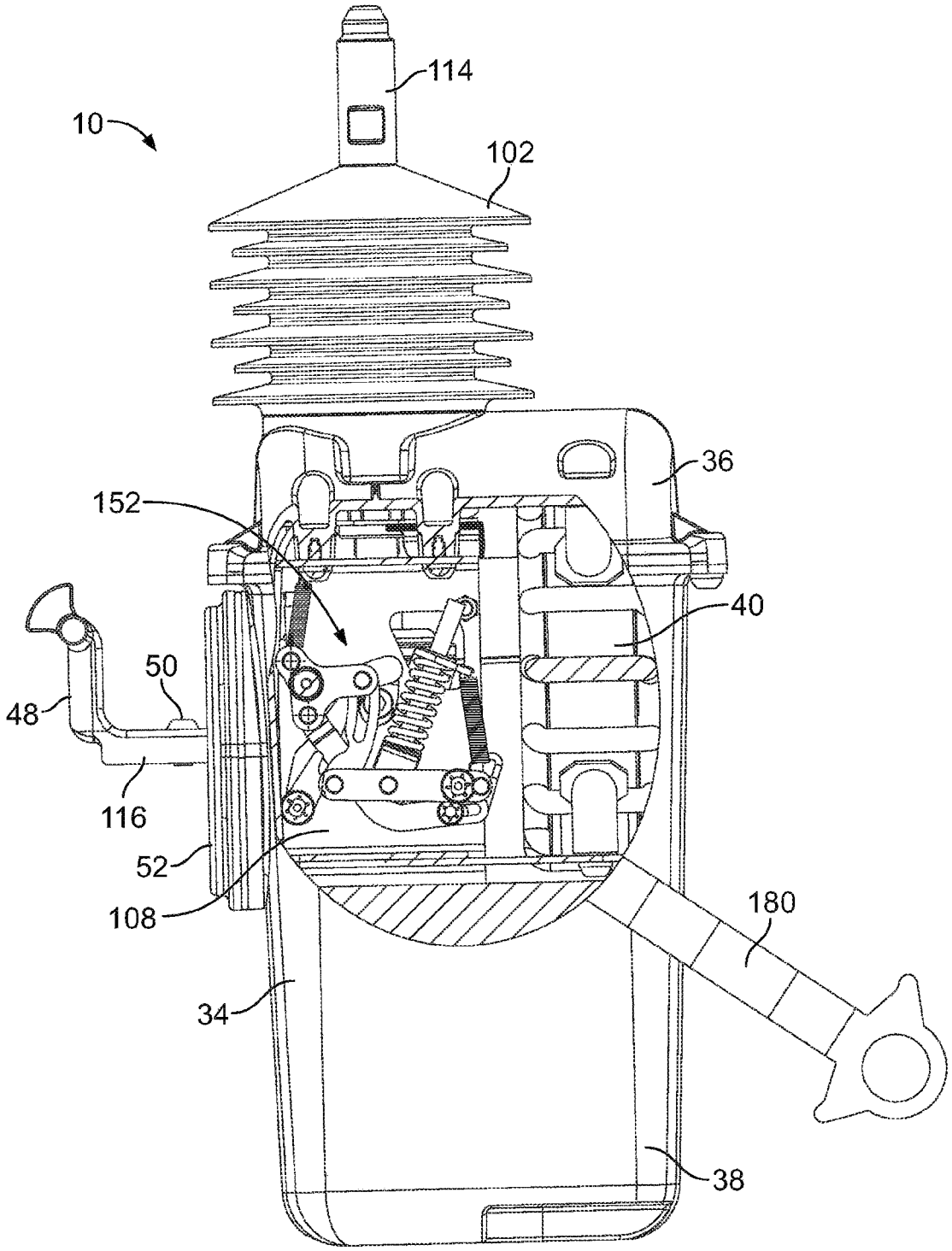
FIG. 4A illustrates a partial cutaway side view of the exemplary recloser depicted in FIG. 2.
Figure 4B:
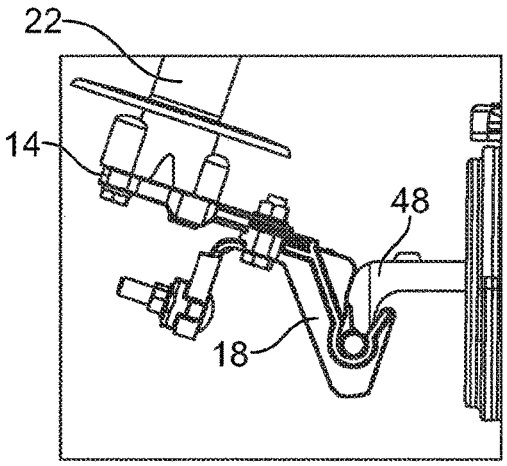
FIG. 4B illustrates an alternative lower terminal trunnion orientation for the recloser depicted in FIG. 4A.
Figure 5:
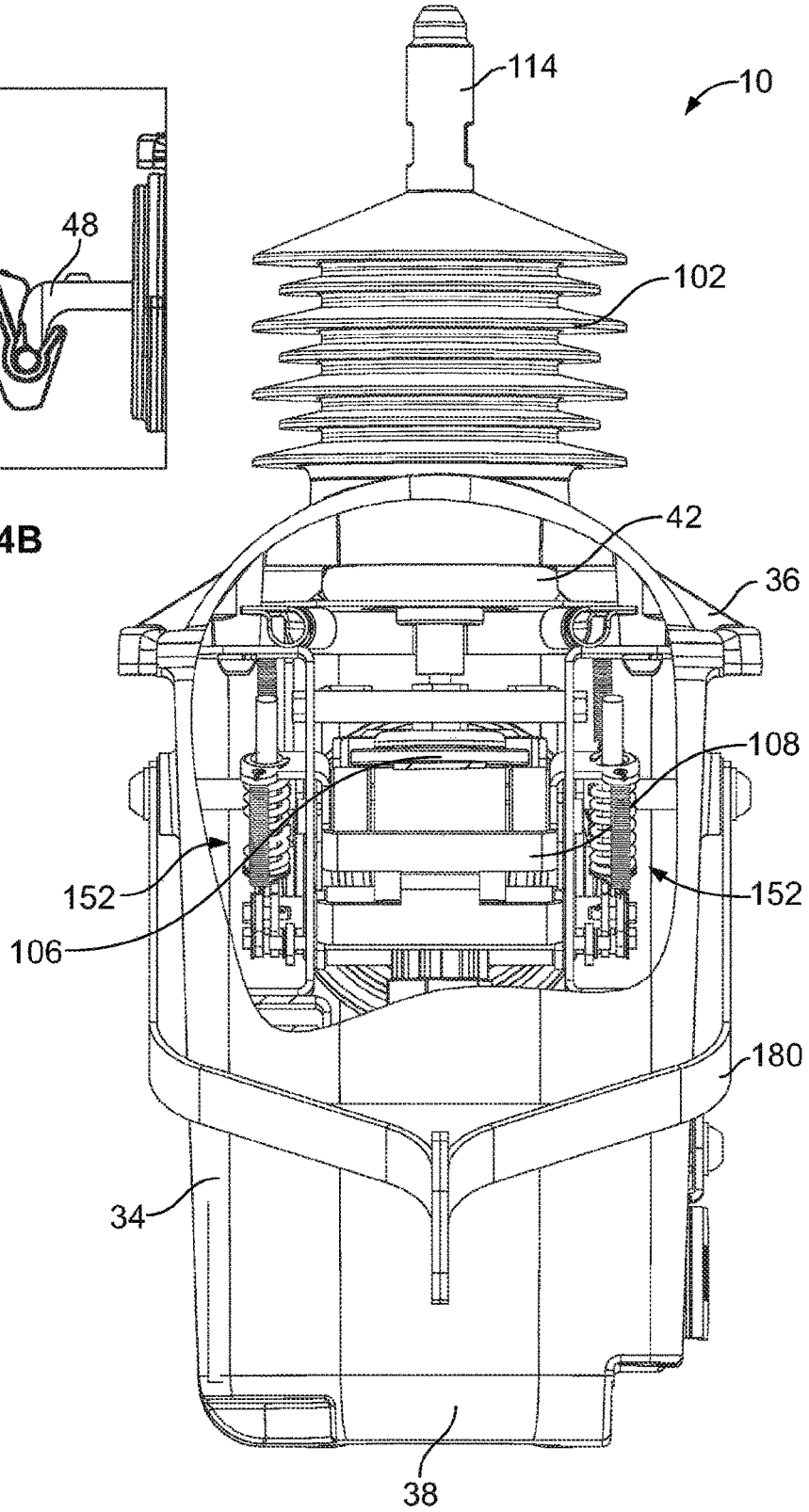
FIG. 5 illustrates a front side view of the exemplary recloser depicted in FIG. 2.

The recloser 10 can also include a second, lower terminal 116 (H2 terminal) that can be secured to the lower hinge support 18 of the cutout 12. According to the illustrated embodiment, the second, lower terminal 116 can include a lower main terminal 46 and a lower terminal trunnion 48. According to certain embodiments, the lower terminal trunnion 48 can be attached to the lower main terminal 46, such as, for example, by a mechanical fastener 50, including but not limited to, a bolt, screw, and/or pin, among other fasteners. Moreover, one or both of the lower main terminal 46 and the lower terminal trunnion 48 can be modular relative to the recloser 10 to at least assist in the recloser 10 being adaptable for use with a variety of different sized, shaped, and/or rated cutouts 12. Additionally, the orientation of the lower terminal trunnion 48 relative to the lower main terminal 46 can be adjusted to further facilitate the adaptability of the recloser 10 to various cutouts 12. For example, the lower terminal trunnion 48 can be sized or configured for different voltage ratings, thereby allowing the remainder of the recloser 10 to be useable in a variety of different rated applications. As shown by at least FIG. 4A, according to certain embodiments, a lower terminal trunnion 48 that is configured for being securely attached to the lower main terminal 46 in a generally upward orientation relative to at least the lower main terminal 46. Such a relative orientation of the lower terminal trunnion 48, as shown in FIG. 4A, can accommodate, for example, the recloser 10 being used with a cutout 12 having a 15-kilovolt (kV) rating, among other cutouts. Conversely, FIG. 4B illustrates another lower terminal trunnion 48 that is different than the lower terminal trunnion 48 shown in FIG. 4A, and which is configured to be securely attached to the lower main terminal 46 in a generally downward orientation relative to at least the lower main terminal 46. Such a relative orientation of the lower terminal trunnion 48 shown in FIG. 4B can accommodate, for example, the recloser 10 being used with a cutout 12 having a 27-kilovolt (kV) rating, among other cutouts. According to certain embodiments, the orientation of the lower terminal trunnion 48 relative to the lower main terminal 46 can be adjusted removal of the fastener 50 from the attachment of the lower terminal trunnion 48 to the lower main terminal 46 (if attached), adjusting the relative reorientation of the lower main terminal 46 and the lower terminal trunnion 48, and the reattachment of the lower terminal trunnion 48 relative to the lower main terminal 46 at the adjusted relative orientation via the fastener 50.

Figure 3:
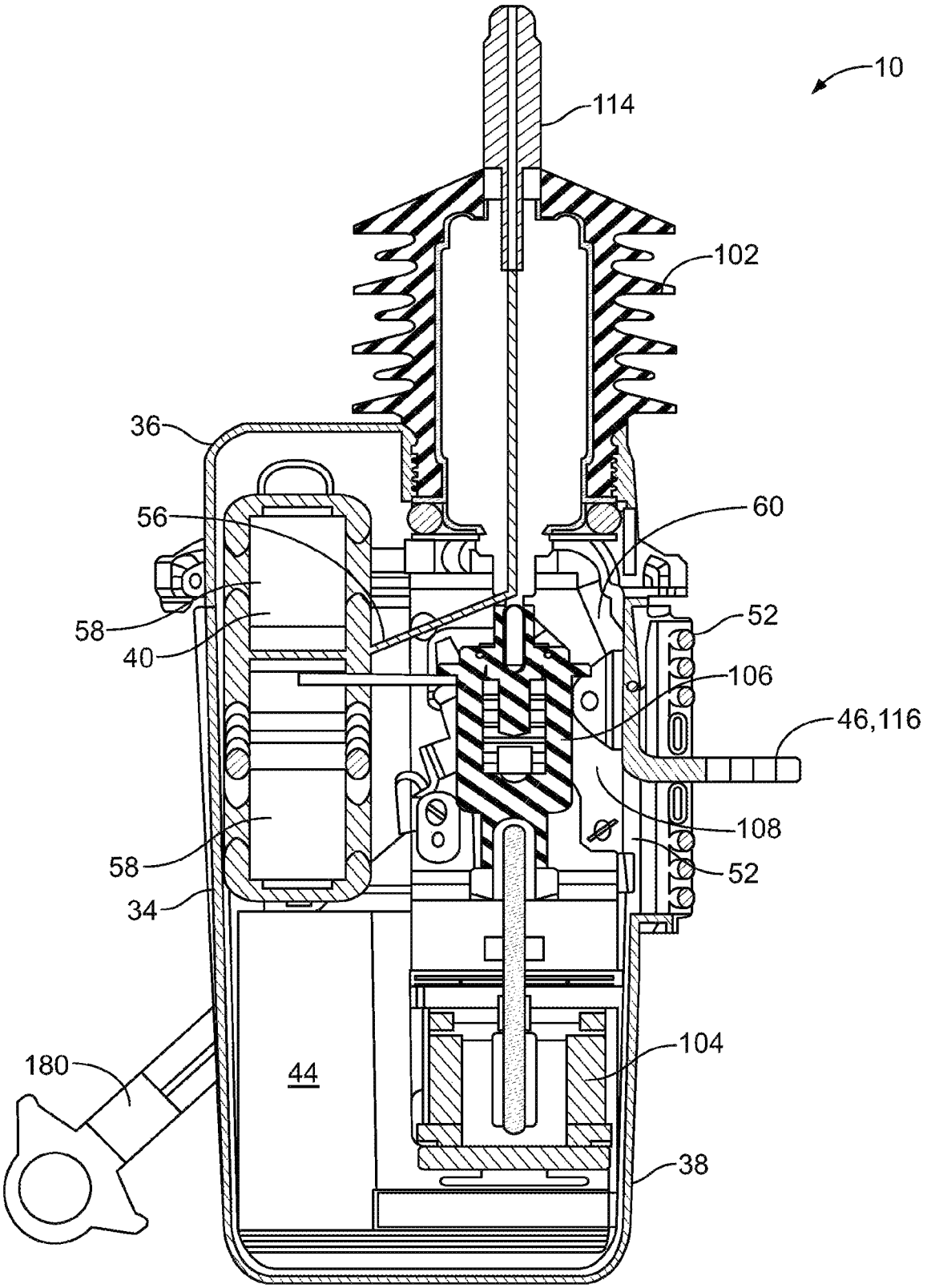
FIG. 3 illustrates a cross sectional side view of the exemplary recloser depicted in FIG. 2.

As shown by at least FIG. 3, according to certain embodiments, at least a portion of the second, lower terminal 116 can extend through an opening 52 in the housing 34, and thus protrude from the housing 34. The opening 52 of the housing 34 can therefore be coupled to a lower terminal gasket 54 that can provide a seal about the opening 52, as well as about a portion of the second, lower terminal 116. Moreover, the lower terminal gasket 54 can be configured to at least attempt to provide a barrier against the ingress of debris or other external matters or elements into the interior space of the housing 34. Further, according to certain embodiments, the lower terminal gasket 54 can be generally flexible so as to accommodate the generally upward and downward pivotal displacement of at least the second, lower terminal 116, including such pivotal displacement of the second, lower terminal 116 associated with generating tension forces selectively used to securely latch recloser 10 to the cutout 12, as discussed below.

As also shown by at least FIG. 3, the current interrupter 102 can, when at least the current interrupter 102 is in the closed position, be electrically coupled to the current transformer 40, such as, for example, via at least a first connector 56. According to the illustrated embodiment, the first connector 56 can be a flexible connector, such as, for example, a wire and/or a collection of wires. The electrical current delivered to the current transformer 40 can then pass at least through the primary windings 58 of the current transformer 40. The current transformer 40 can be electrically coupled to the second, lower terminal 116, such as, for example via at least a second connector 60. Similar to the first connector 56, according to the illustrated embodiment, the second connector 60 can be a flexible connector, such as, for example, a wire and/or a collection of wires. At least a portion of the electrical current flowing through the recloser 10 can also flow through, or by, a variety of other components of the recloser 10, including, for example, the current sensor(s) 42, as well as the electronics 44, which, again, can include one or more energy storage devices that can store at least a portion of the received primary electrical power for subsequent use for operating at least the electromagnetic actuator 104.

Figure 12:
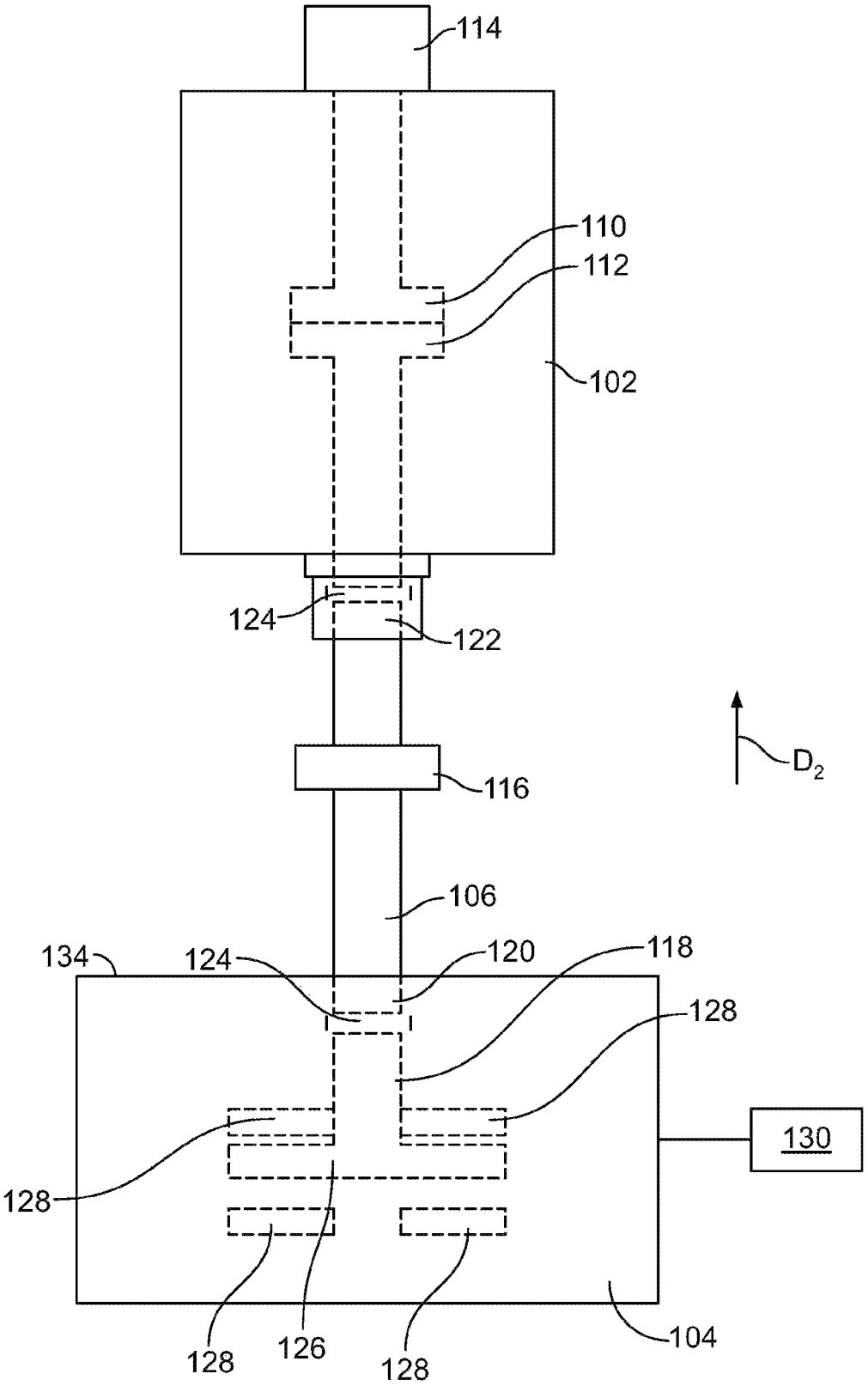
FIGS. 12 and 13 illustrate a schematic representation of portions of a recloser in closed and opened positions, respectively.
Figure 13:
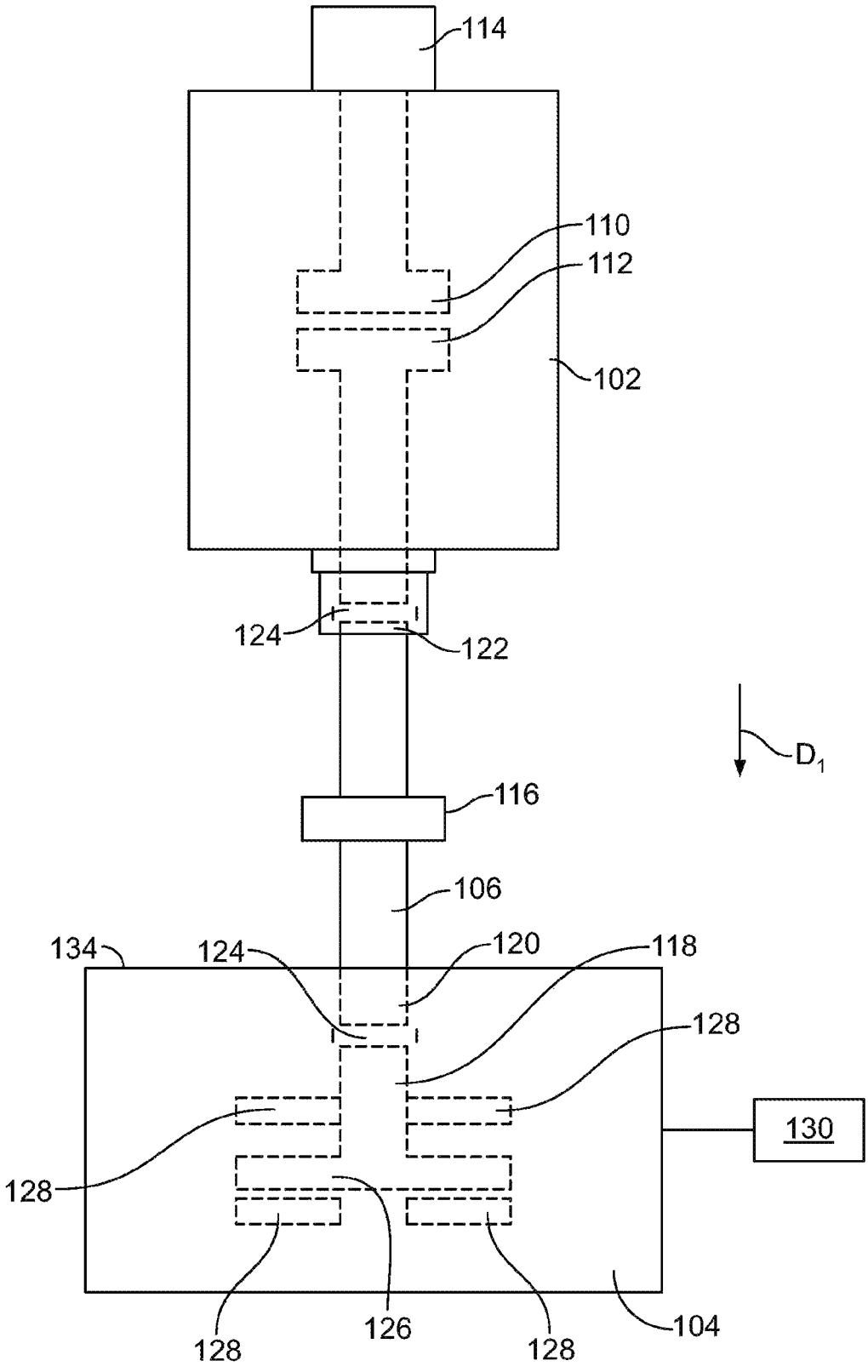

According to certain embodiments, the current interrupter 102 can be coupled to the upper housing portion 36, such as, for example, via a threaded connection. A variety of different types of current interrupters can be used as the current interrupter 102 for the recloser 10 and/or the recloser assembly 100, including, for example, an embedded vacuum interrupter and a gas current interrupter, among other types of current interrupters. For at least purposes of discussion, FIGS. 12 and 13 depict a schematic representation of portions of an exemplary current interrupter 102. As shown, the current interrupter 102 can include a fixed contact 110 and a moveable contact 112, the fixed contact 110 being electrically coupled to the first terminal 114. Further, as previously discussed, the moveable contact 112 can be electrically coupled to the lower terminal 116 via other components of the recloser 10. As also previously discussed, an incoming flow or supply of electricity can flow through the first terminal 114 and to the recloser assembly 100. Accordingly, when the current interrupter 102 is in a closed position, as shown for example in FIG. 12, the fixed contact 110 is electrically coupled to, or otherwise in operable contact with, the moveable contact 112, such that the incoming supply or flow of electricity can pass from the first terminal 114 and fixed contact 110 to the moveable contact 112, and eventually to the second, lower terminal 116. According to certain embodiments, the second terminal 116 can be operably coupled to a current transmission line, among other components.

Conversely, when the current interrupter 102 is in an open position, as shown for example by FIG. 13, the moveable contact 112 can be positioned away from the fixed contact 110 such that the moveable contact 112 is no longer electrically coupled to the fixed contact 110. For example, in the embodiment depicted in FIG. 13, the fixed contact has been generally linearly displaced in a first direction (as indicated by direction "$D_1$" in FIG. 13) away from the fixed contact 110 such that the moveable contact 112 is no longer electrically coupled to the fixed contact 110, and the current interrupter is thus open. Accordingly, when the current interrupter 102 is in the open position, electricity cannot flow through the current interrupter 102, and thus the flow of current to at least the second terminal 116 is interrupted.

According to the illustrated embodiment, the electromagnetic actuator 102, which, again, can be housed within the housing 34, can be electrically controlled to displace the moveable contact 112 away from, as well as toward, the fixed contact 110 so that the current interrupter 102 is selectively placed in the corresponding open or closed positions. While the recloser 10 can employ a variety of different types of electromagnetic actuators, according to the illustrated embodiment, the illustrated electromagnet actuator includes an actuator arm 118 that is coupled to a first end 120 of the pushrod 106, a second end 122 of the pushrod 106 being coupled to the moveable contact 112. While the first and second ends 120, 122 of the pushrod 106 can be coupled to the actuator arm 118 and the moveable contact 112, respectively, in a variety of different manners, as shown by the schematics of FIGS. 12 and 13, according to the illustrated embodiment, the pushrod 106 can be coupled to each of the actuator arm 118 and the moveable contact 112 by a mechanical coupler(s) 124. Further, according to certain embodiments, the pushrod 106 can comprise a plurality or assembly of components, devices, and/or parts.

According to certain embodiments, the actuator arm 118 can include an armature 126 that is constructed from an electrically conductive material, such as for example, aluminum or copper. Further, according to certain embodiments, the electromagnetic actuator 104 can include one or more primary coils 128 that can comprise a conductor that is wound in a number of turns, and which is connected to a power source 130. For example, the primary coil(s) 128 of the electromagnetic actuator 104 can be connected to a primary power source 130 through which electrical power is provided to the recloser 10, and/or to power source 130 in the form of one more power storage devices or components, such as, for example, one or more capacitors or a capacitor bank of the electronics associated with the recloser 10 and/or electromagnetic actuator 104, among other storage devices and components. Additionally, according to certain embodiments, rather than including an armature 126, the actuator arm 118 can include coils that are wound in a direction opposite to that of the primary coils 128 of the electromagnetic actuator 104, and which can be electrically coupled to the power source 130.

When the electromagnetic actuator 104 is to open the current interrupter 102, such as, for example, upon detection of a fault current, the power source 130 can provide a current that flows through the primary coil(s) 128 of the electromagnetic actuator 104 in a manner that generates a relatively strong magnetic field around the primary coil(s) 128. The generated magnetic field can induce eddy currents in the armature 126 of the actuator arm 118 in a manner that repels, or otherwise displaces, via an electromagnetic force, the armature 126 generally in the first direction ("$D_1$" in FIG. 13) and away from the primary coil(s) 128. As the actuator arm 118 is coupled to the moveable contact 112 via the pushrod 106, such displacement of the armature 126 can facilitate displacement of the moveable contact 112 away from the fixed contact 110 to open the current interrupter 102, as shown in FIG. 13.

Figure 11:
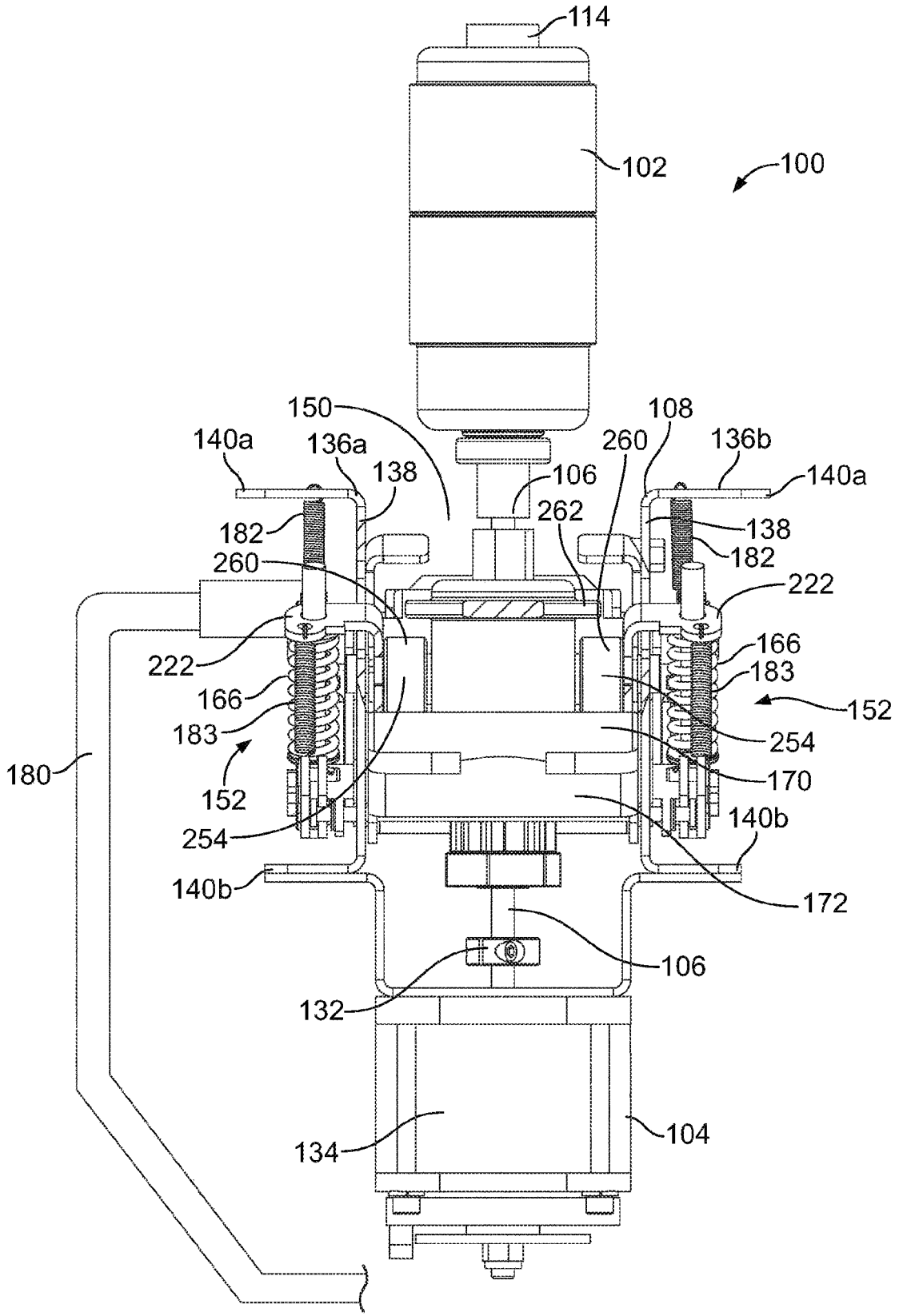
FIG. 11 illustrates a front view of the recloser assembly depicted in FIG. 6 that is coupled to a driver.

The distance the pushrod 106, and thus at least the moveable contact 112, can be displaced in the first direction (as indicated by direction "$D_1$" in FIG. 13), can be limited in a variety of different manners, including, for example, by the relatively secure attachment of a limiting body 132 to at least a portion of the pushrod 106 relative to a portion of the electromagnetic actuator 104, as shown for example, in at least FIGS. 6 and 11. Moreover, when the pushrod 106 is being displaced generally in the first direction when current interrupter 102 is being opened, the limiting body 132 can be moved into contact with the electromagnetic actuator 104, such as, for example, a housing 134 of the electromagnetic actuator 104, among other portions of the electromagnetic actuator 104, which can prevent further displacement of at least the pushrod 106 in the first direction.

According to certain embodiments, after facilitating the opening of the current interrupter 102, current provided by the power source 130 can flow through the primary coil(s) 128 in a manner or direction that attracts the armature 126 toward the primary coil(s) 128. Such displacement of the armature 126, and thus the pushrod 106 and the moveable contact 112 coupled thereto, can generally be in a second linear direction (as indicated by "$D_2$" in FIG. 12) so that the moveable contact 112 can be moved to a position at which the moveable contact 112 becomes electrically coupled with the fixed contact 110. As previously discussed, with the moveable contact 112 electrically coupled to the fixed contact 110, the current interrupter 102 can again be in the closed position, as generally indicated in FIG. 12.

In certain situations, when the current interrupter 102 is in the open position, the power source 130 may be unavailable, or otherwise may have insufficient power to facilitate displacement, via operation of the electromagnetic actuator 104, of at least the pushrod 106 in the second direction. Further, with the current interrupter 102 opened for a certain duration of time, energy storage devices, such as, for example, one or more capacitors or capacitor banks of the power source 130, can be depleted such that insufficient current is unavailable to operate the electromagnetic actuator 104 in a manner that can facilitate the closing of the opened current interrupter 102. In such situations, the closing mechanism 108 can, as discussed below, be operated to release mechanical energy that is stored by the closing mechanism 108 to close the recloser 10, and, moreover, close the current interrupter 102 via mechanical, rather than magnetic, displacement of the pushrod 106. Such closing of the current interrupter 102 can, if primary power is available, facilitate a supply of energy for storage by the power source 130 and/or for operation of the electromagnetic actuator 104 such that the electromagnetic actuator 104 can subsequently, in a relatively short time period, be capable of re-opening the closed current interrupter 102. Thus, as discussed below, in addition to being configured to mechanically close the opened recloser 10, and more specifically the current interrupter 102, at least a portion of the closing mechanism 108 can also be configured to relatively quickly be displaced to a position that prevents the closing mechanism 108 from interfering with potential subsequent reopening of the current interrupter 102 by operation of the electromagnetic actuator 104.

As shown in at least FIGS. 6 and 11, according to the illustrated embodiment, the closing mechanism 108 can include opposing first and second closer brackets 136*a*, 136*b*. According to the illustrated embodiment, one or both of the first and second closer brackets 136*a*, 136*b* can include a sidewall 138, a first attachment flange 140*a*, and a second attachment flange 140*b*, the sidewall 138 being generally positioned between the first and second attachment flanges 140*a*, 140*b*. Further, the first and second attachment flanges 140*a*, 140*b* can generally extend outwardly from upper and lower portions, respectively, of the sidewall 138. According to the illustrated embodiment, the first and second attachment flanges 140*a*, 140*b* can generally be orthogonal to the sidewall 138. Additionally, the first and second attachment flanges 140*a*, 140*b* can be configured to attach the closing mechanism 108 to other components and/or brackets 136*a*, 136*b* of the recloser 10, among other components. For example, according to certain embodiments, the first and second attachment flanges 140*a*, 140*b* can include one or more through-holes 142 sized to receive insertion of a mechanical fastener, such as, for example, a bolt, screw, pin, and/or nut, among other fasteners. Additionally, according to certain embodiments, one or more of the through-holes 142 can include an internal thread.

According to certain embodiments, the first closer bracket 136*a* can be coupled at one or more locations to the second closer bracket 136*b*. For example, as shown in at least FIG. 6, the first closer bracket 136*a* can be attached to the second closer bracket 136*b* by one or more extension members 144 that passes through apertures in the first and second closer brackets 136*a*, 136*b*. In the illustrated embodiment, opposing ends of the extension member 144 can be threadingly secured to a nut, among other manners or attachment. Further, the extension member(s) 144 can be sized to separate the first and second closer brackets 136*a*, 136*b* by a predetermined distance. However, the first and second closer brackets 136*a*, 136*b* can be secured relative to each other in a variety of other manners.

The sidewall 138 of the first and second closer brackets 136*a*, 136*b* can include and an outer surface 146 and an inner surface 148. The inner surfaces 148 of the sidewalls 138 of the first and second closer brackets 136*a*, 136*b* can generally define an interior region 150 of the closing mechanism 108 that houses at least a portion components of the closing mechanism 108 that can selectively physically engage or contact at least a portion of the pushrod 106 to mechanically displace the pushrod 106 in a the second direction (a generally indicated by direction "$D_2$" in FIG. 12) to a position that closes the current interrupter 102, as discussed below. Additionally, the outer surface 146 of one or both of the first and second closer brackets 136*a*, 136*b* can generally be adjacent to at least a portion of a linkage system 152 of the closing mechanism 108 that can store, as well as release, the mechanical force used to displace the pushrod 106 to facilitate the closing of an opened current interrupter 102.

For at least purposes of discussion, the linkage system 152 is discussed below with respect to the first closer bracket 136*a*. However, according to certain embodiments, the below discussed a similar linkage system 152 can also, or, optionally, alternatively, be positioned about the second closer bracket 136*b*. Thus, as indicated by at least FIGS. 6 and 11, according to certain embodiments, linkage systems 152 can be positioned adjacent to the outer surfaces 146 of the sidewalls 138 of both the first and second closer brackets 136*a*, 136*b*. According to certain embodiments, each linkage system 152 can include a secondary latch lever 154, a driving fork 156, a link guide 158, a spring arm 160, a release link 162, a guide body 164, a biasing element 166, a close latch 168, a main bracket 170, and a release bracket 172.

The driving fork 156 is rotably coupled to the sidewall 138. According to certain embodiments, the driving fork 156 can rotate about a central axis 174 (FIG. 7) that is generally perpendicular to the above-discussed first and second linear directions of displacement of the pushrod 106. According to the illustrated embodiment, the driving fork 156 can have an outwardly radially extending first leg 176*a*, second leg 176*b*, and third leg 176*c*. Further, one or more of the first, second, and third legs 176*a-c* can have a different length than at least another leg 176*a-c*. As shown in at least FIGS. 7 and 8, according to the illustrated embodiment, the first, second, and third legs 176*a-c* can be arranged to provide the driving fork 156 with a generally triangular shape.

The driving fork 156 can also include, or be coupled to, a driven hub 178 that is configured for selective coupling of the driving fork 156 with the driver 180, such as, for example, a handle. For example, the driven hub 178 can have a configuration that accommodates mating engagement of the driven hub 178 with the driver 180 such that rotational displacement of the driver 180 can be translated to the driving fork 156 via the driven hub 178. According to certain embodiments, the driven hub 178 is a non-round protrusion, such as, for example, a protrusion having at least one outer flat side edge such that rotation of the driver 180 can be translated to rotational displacement of at least the driven hub 178. While the driver 180 illustrated in FIG. 11 is depicted as a handle that engages a single driver, as shown in at least FIG. 5, the driver 180 can have a variety of other configurations, shapes, and sizes, including, for example, a driver 180 that can simultaneously engage a driven hub 178 of two linkage systems 152, one of each linkage systems 152 being adjacent to outer surfaces of opposing closer brackets 136*a*, 136*b*, as well as be pivotally coupled to the housing 34, such as, for example, the lower housing portion 38. Additionally, according to certain embodiments, the driver 180 can be indirectly coupled to the driven hub 178. For example, a portion of the driver 180 external to the inner region of the housing 34 of the recloser 10 can be connected to a first end of a shaft, the second end of the shaft being coupled to the driven hub 178. Further, such rotational displacement of the driver 180 can include, for example, lifting the driver 180 from a lower position, such as, for example, a vertical positioned generally aligned with or below the electromagnetic actuator 104, in a direction generally toward of the current interrupter 102 and/or pulling the driver 180 from an upper position, such as, for example a vertical position generally aligned with or above the current interrupter 102, in a direction generally toward the electromagnetic actuator 104.

Figure 7:
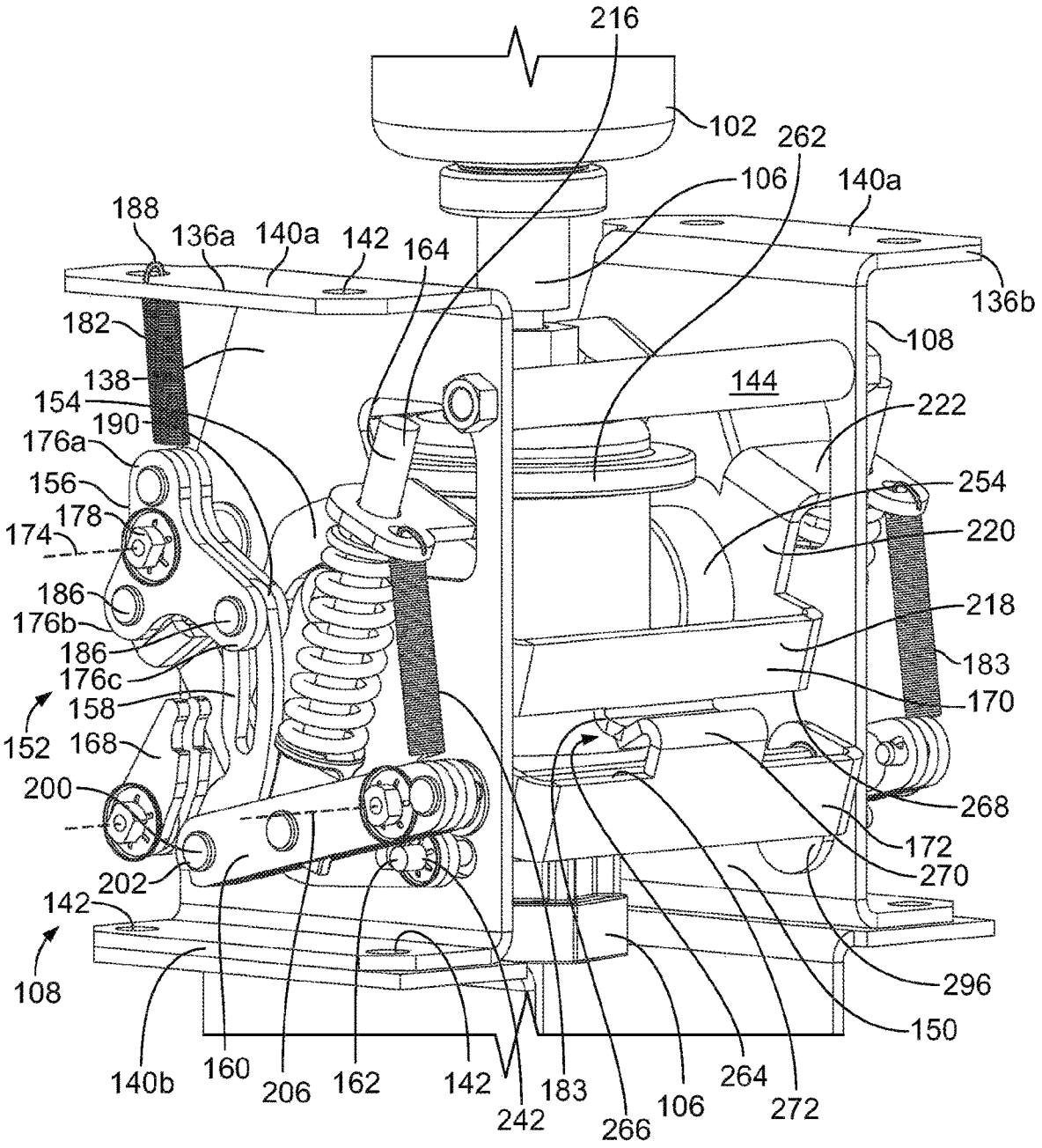
FIGS. 7 and 8 illustrate a front side perspective view and a side view, respectively, of a closing mechanism of the recloser depicted in FIG. 6.
Figure 8:
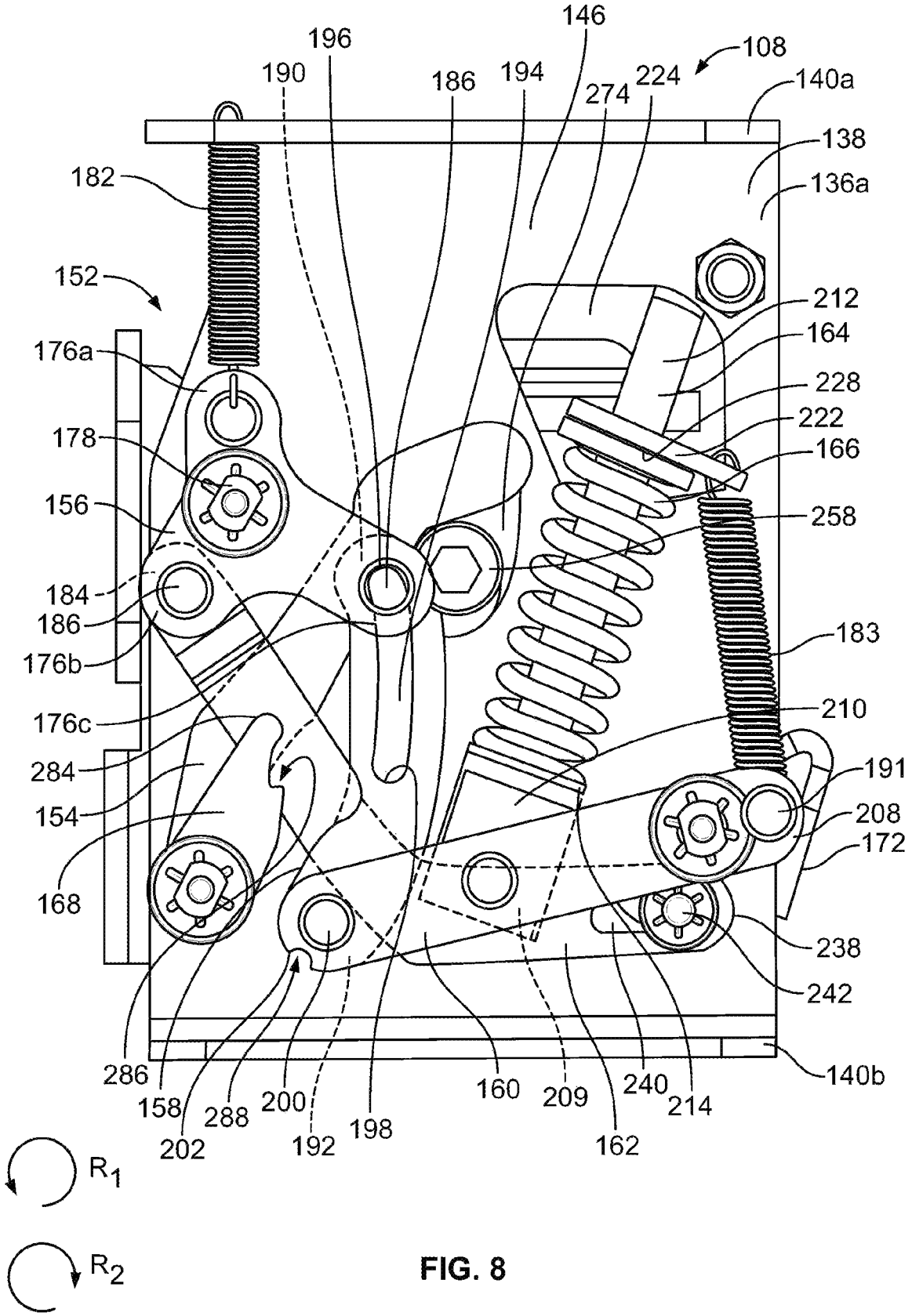
Figure 9:
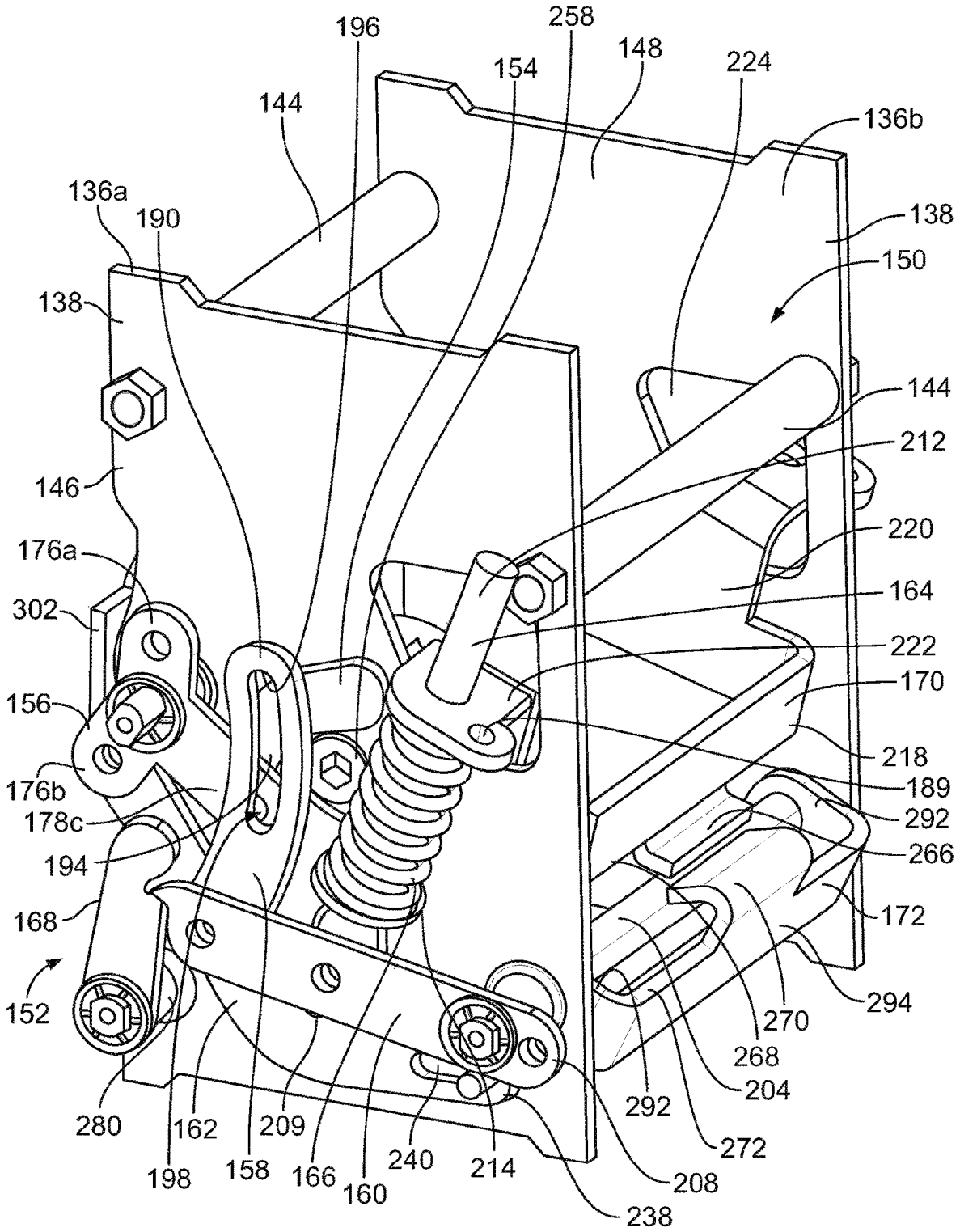
FIGS. 9 and 10 illustrate front and rear side perspective views, respectively, of a portion of the closing mechanism shown in FIG. 6, as well as a phantom view of a portion of a pushrod.
Figure 10:
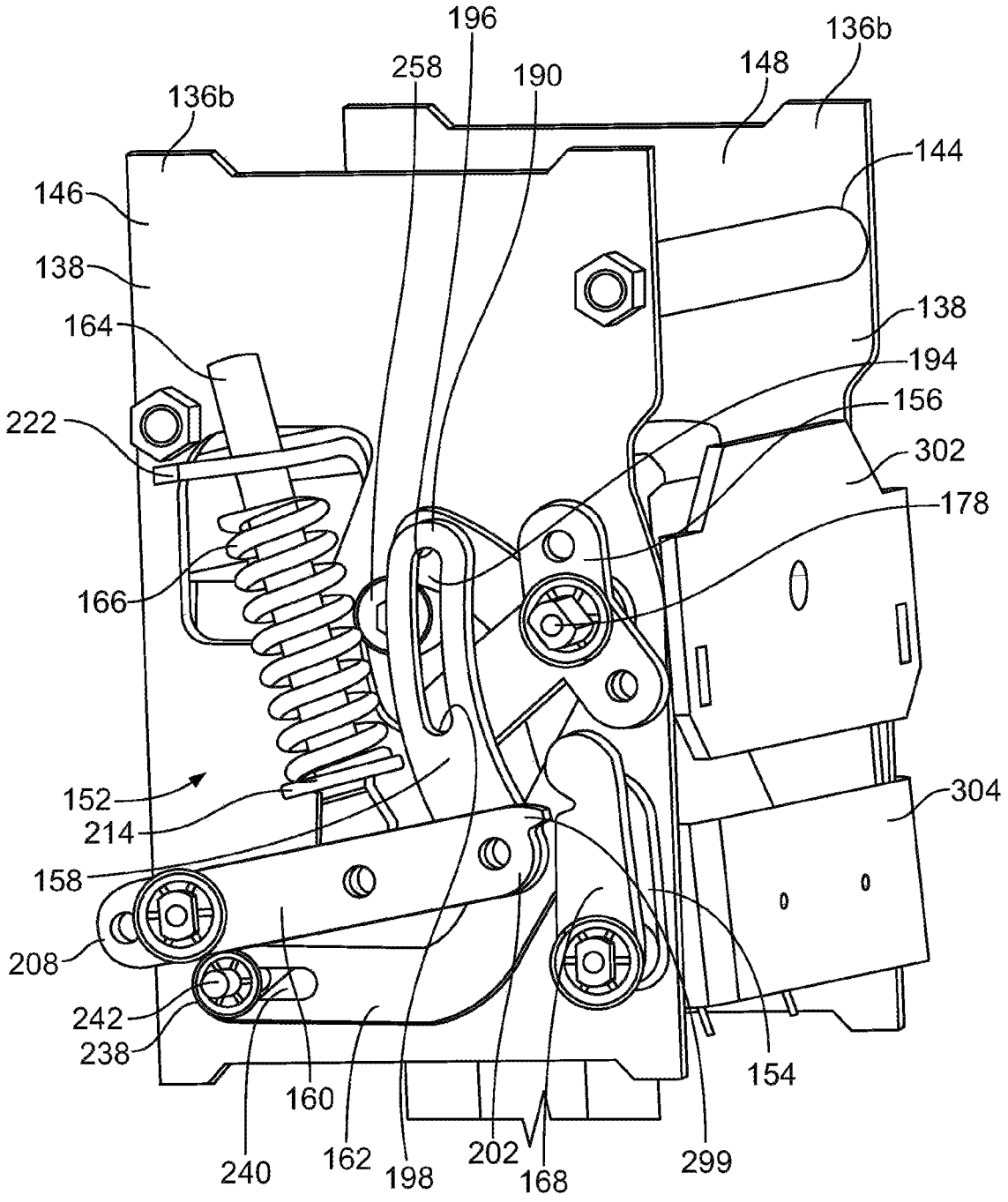

The first leg 176*a* of the driving fork 156 can be coupled to a secondary biasing element 182, such as, for example, a spring, that can be configured to assist in biasing the driving fork 156 to a neutral position, as shown, for example, in at least FIGS. 7 and 8. According to certain embodiments, a first end of the secondary biasing element 182 can include a hook or other attachment structure that can be relatively securely coupled to the first leg 176*a*, such as, for example, extend into an aperture or through-hole in the first leg 176*a* to securely engage an adjacent portion of the first leg 176*a*. A second, opposing end 188 of the secondary biasing element 182 can be attached to a portion of the first closer bracket 136*a*, such as, for example, coupled to the first attachment flange 140*a*. For example, the second end 188 of the secondary biasing element 182 can extend through a through-hole 142 in the first attachment flange 140*a* and securely engage an adjacent portion of the first attachment flange 140*a*.

As shown by at least FIGS. 7 and 8, according to the illustrated embodiment, when the driving fork 156 is in the neutral position, the first leg 176*a* outwardly extends in a direction that is generally parallel to the path of linear displacement of the pushrod 106 when the current interrupter 102 is being opened and/or closed. As discussed below, and in relation to at least the orientation depicted in FIG. 8, in at least certain situations, the driving fork 156 can be rotably displaced in a first, counterclockwise direction (as indicated by "$R_1$" in FIG. 8), or, alternatively, and a second, clockwise direction (as indicated by "$R_1$" in FIG. 8), in response to a rotational force being translated to the driving fork 156 via operation of the driver 180, and/or in response to a rotational force(s) generated during at least operation of the closing mechanism 108. In such situations, upon the removal of such rotational forces and/or such rotational forces being insufficient to overcome the biasing force of the secondary biasing element 182, the secondary biasing element 182 can provide a force(s) that returns the driving fork 156 generally back to the neutral position.

Additionally, as also discussed below, the second leg 176*b* of the drive fork 156 can be pivotally coupled to a first end 184 of the release link 162, while the third leg 176*c* can be coupled to the link guide 158. For example, according to certain embodiments, a guide pin 186 can extend through a through-hole of, or otherwise project from, each of the second and third legs 176*b*, 176*c* in a manner that rotably couples the second and third legs 176*b*, 176*c* to the secondary latch lever 162 and the link guide 158, respectively.

As shown in at least FIGS. 7-10, the link guide 158 can include a first end 190, a second end 192, and an elongated guide slot 194. According to the illustrated embodiment, the link guide 158 has a generally curved or arced shape. The elongated guide slot 194 can extend between a first slot end 196 and a second slot end 198, the first slot end 196 being in relatively close proximity to, or otherwise generally adjacent to, the first end 190 of the link guide 158. Further, at least the elongated guide slot 194 can have generally curved or arced shaped that follows the arcuate path of travel of the third leg 176*c* associated with the rotational displacement of the driving fork 156. For example, according to certain embodiments, the elongated guide slot 194 can have a curved shape such that the guide pin 186 that is coupled to the third leg 176*c* and which is positioned within the elongated guide slot 194 can travel between the first and second slot ends 196, 198 of the elongated guide slot 194 as the driving fork 156 is rotated while the link guide 158 remains relatively static. Further, according to such an embodiment, the first slot end 196 can be positioned such that when the driving fork 156 is rotated in the first, counterclockwise direction, as shown in relation to the orientation of the linkage system 152 depicted in at least FIG. 8, the guide pin 186 can be displaced to a position at which the guide pin 186 can exert a force against the link guide 158 at or around the first slot end 196 that facilitates at least similar pivotal displacement of the link guide 158 in the first, counterclockwise direction. Similarly, the second slot end 198 can be positioned such that when the driving fork 156 is rotated in the second, clockwise direction, the guide pin 186 can be displaced to a position at which the guide pin 186 can generally be positioned at or around the second slot end 198 such that the guide pin 186 is not positioned to interfere with subsequent displacement of the link guide 158 as the link guide 158 is subsequently displaced relative the guide pin 186.

The link guide 158 can also be pivotally coupled to the spring arm 160. More specifically, according to the illustrated embodiment, the second end 192 of the link guide 158 can be pivotally coupled, such as, for example, by an arm pin 200, to the spring arm 160 at or around a first end 202 of the spring arm 160. According to certain embodiments, the arm pin 200 can be a pin or mechanical fastener that extends at least partially through orifices of the link guide 158 and spring arm 160. Alternatively, according to other embodiments, the arm pin 200 can be a protrusion of one of the link guide 158 and spring arm 160 that is received in an opening in the other of the link guide 158 and spring arm 160.

The spring arm 160, at or around a second end 208 of the spring arm 160, can also be pivotally coupled to a release bracket shaft 204 (FIGS. 9 and 16) such that the spring arm 160 is pivotable relative to at least the sidewall 138 of the adjacent closer bracket 136*a*, 136*b* about a central axis 206 (FIG. 7). According to certain embodiments, at least one of the spring arm 160, the release bracket shaft 204, and/or other associated coupling device(s), including, for example, a pin or bolt, among other devices or components, can extend through an aperture in the sidewall(s) 138 of the adjacent closer bracket 136*a*, 136*b*. Further, the central axis 206 about which at least the spring arm 160 pivotally rotates relative to the adjacent closer bracket 136*a*, 136*b* can be generally parallel to the central axis 174 about which the link guide 158 rotates relative to the adjacent closer bracket 136*a*, 136*b*.

The spring arm 160 can also be pivotally coupled to a first end 209 of the guide body 164. According to the illustrated embodiment, the guide body 164 includes a base 210 and a guide rod 212, the base 210 being generally positioned around at least the first end 209 of the guide body 164, and the guide rod 212 generally extending from the base 210. The guide rod 212 can have an outer size, such as, for example, a diameter or width, that can accommodate placement of the biasing element 166, such as, for example, a spring, about, or around, at least a portion of the guide rod 212. For example, an inner size, such as, for example, an inner diameter, of the biasing element 166 can be sized relative to a corresponding outer size of the guide rod 212 such that the biasing element 166 can be positioned about or over, as well as capable of being generally linearly displaced along, at least a portion of the guide rod 212. Additionally, the base 210 can have a size, such as, for example, a width, that is at least as large as, if not larger than, the inner diameter of the biasing element 166 such that a wall of the base 210 that is adjacent to the biasing element 166 provides a first shoulder 214 that can support the biasing element 166 and/or provide interference to at least assist in retaining the biasing element 166 on the guide rod 212. Further, the first shoulder 214, as well as a portion of the main bracket 170 can be positioned to at least compress or charge the biasing element 166 such that, when the biasing element 166 is discharged, the biasing element 166 can provide a force used to displace the pushrod to a position that closes an open current interrupter 102, as discussed below.

According to the illustrated embodiment, a portion of the guide body 164 that is generally approximate to a second end 216 of the guide body 164 can be sized to accommodate at least a portion of the guide body 164 being slidingly coupled to the main bracket 170. Further, according to the illustrated embodiment, the main bracket 170 includes a bracket body 218 and a pair of sidewalls 220. The bracket body 218 can generally extend in the interior region 150 of the closing mechanism 108 at least a portion of the distance between the inner surfaces 148 of the first and second closer brackets 136*a*, 136*b*. Each sidewall 220 of the main bracket 170 can include an arm 222 that extends from the interior region 150 of the closing mechanism 108 and through an aperture 224 in the sidewall 138 such that the arm 222 can be coupled to the guide body 164. The aperture 224 in the sidewall 138 can be sized to accommodate displacement of the main bracket 170 that is associated with the pushrod 106 being displaced to a position that closes the opened current interrupter 102. According to the illustrated embodiment, the arm 222 includes an orifice 226 that receives slideable placement of at least a portion of the guide rod 212. Further, similar to the base 210, the arm 222 can have a size, such as, for example, a width, that is at least as large as, if not larger than, the inner diameter of the biasing element 166 such that that arm 222 provides a second shoulder 228 that provides interference for at least assisting in retaining the biasing element 166 on the guide rod 212. When charged, the biasing element 166 can be compressed or otherwise charged between the first shoulder 214 of the guide body 164 and the second shoulder 228 of the arm 222. Additionally, as discussed below, rotational displacement of the guide body 164 can facilitate rotational displacement of the main bracket 170, as rotation of the guide rod 212 can exert a force against at least a portion of the arm 222 at or around the orifice 226 that can translate a rotational force to the main bracket 170.

Figure 16:
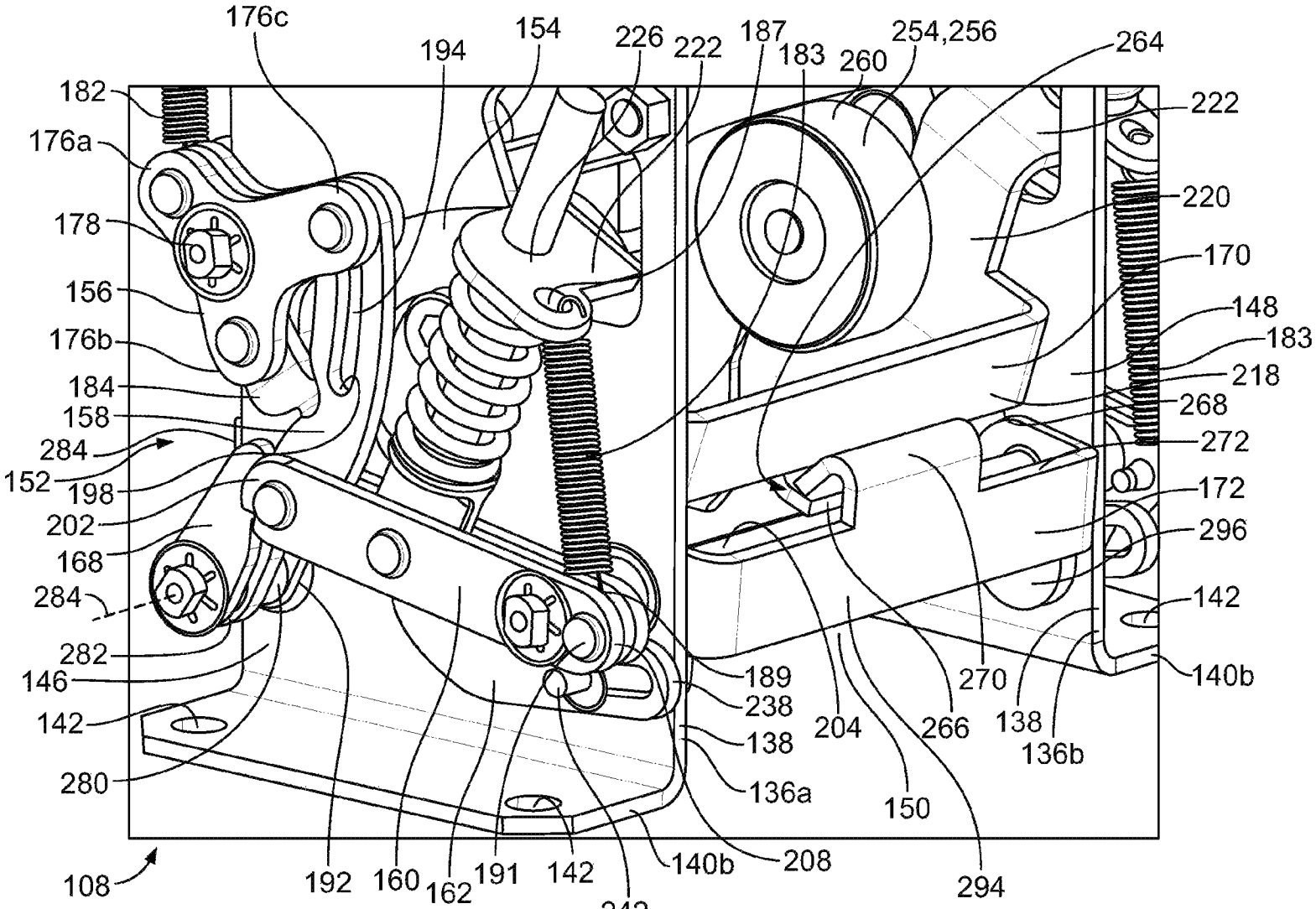
FIG. 16 illustrates a side perspective view of a lower portion of an exemplary closing mechanism.

As shown by at least FIG. 16, the main bracket 170 can be coupled to the spring arm 160 by a secondary biasing element 183. According to the illustrated embodiment, a first end 185 of the secondary mechanical biasing element 183 can extend through a portion of an opening 187 in the arm 222 of the sidewall 220 of the main bracket 170 and relatively securely engage a surface of the arm 222. A second end 189 of the secondary mechanical biasing element 183 can be coupled to another portion of the linkage system 152, such as, for example, a portion of a pin 191 that is coupled to the spring arm 160 in the general vicinity of the second end 208 of the spring arm 160. Further, according to the illustrated embodiment, the secondary mechanical biasing element 183, such as, for example, a spring, can provide a generally downward biasing force that biases at least the arm 222 of the main bracket 170 toward the spring arm 160, and moreover, seeks to at least attempt to provide a generally downward force against the arm 222 that can, after the closing mechanism 108 has been discharged, at least assist in displacing the main bracket 170 and components coupled thereto to a location(s) that prevents or minimizes the closing mechanism 108 from interfering with displacement of the pushrod 106 that may be associated with operation of the electromagnetic actuator 104, as discussed below.

Figure 14:
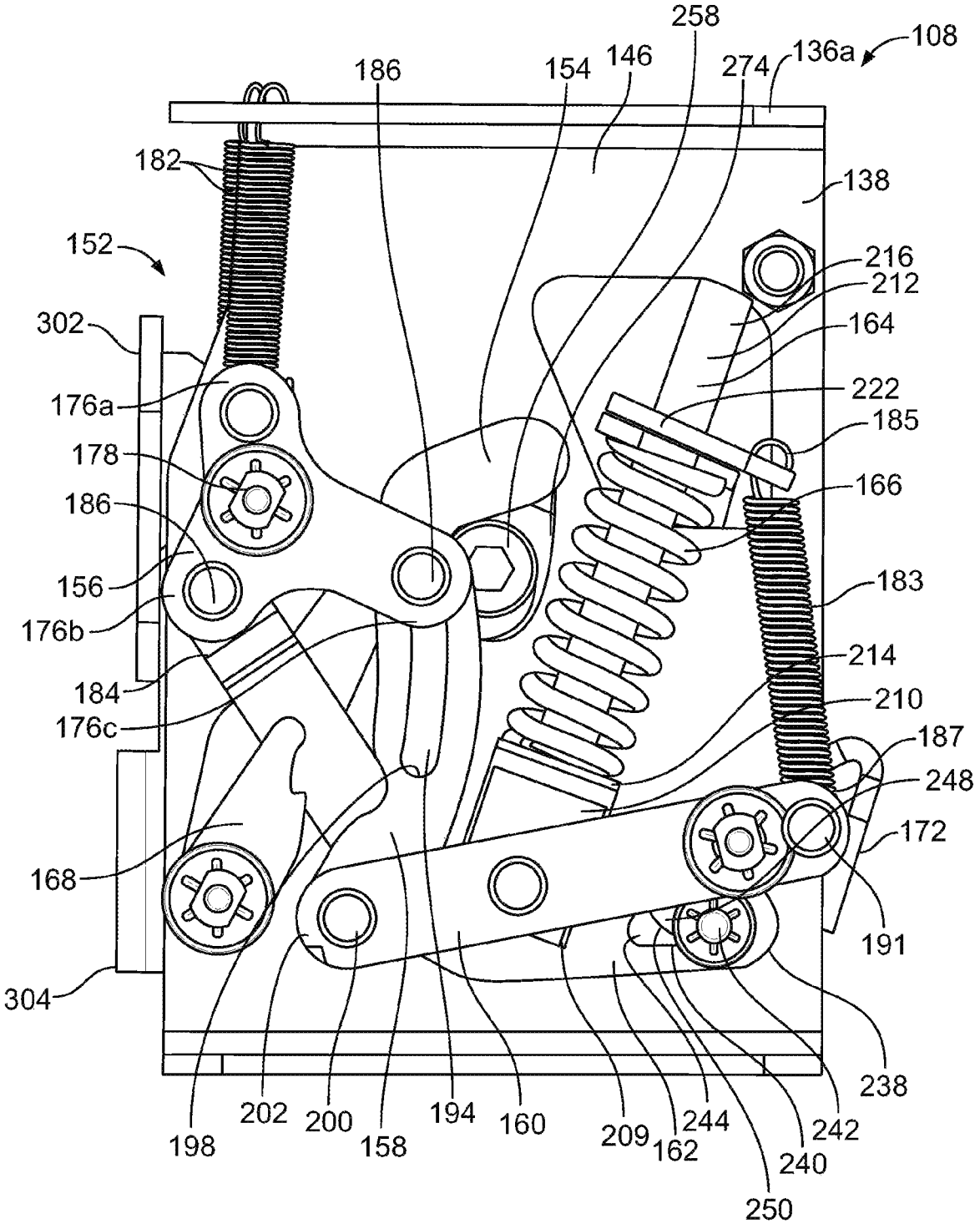
FIG. 14 illustrates a side view of a portion of an exemplary closing mechanism in a discharged state.
Figure 15:
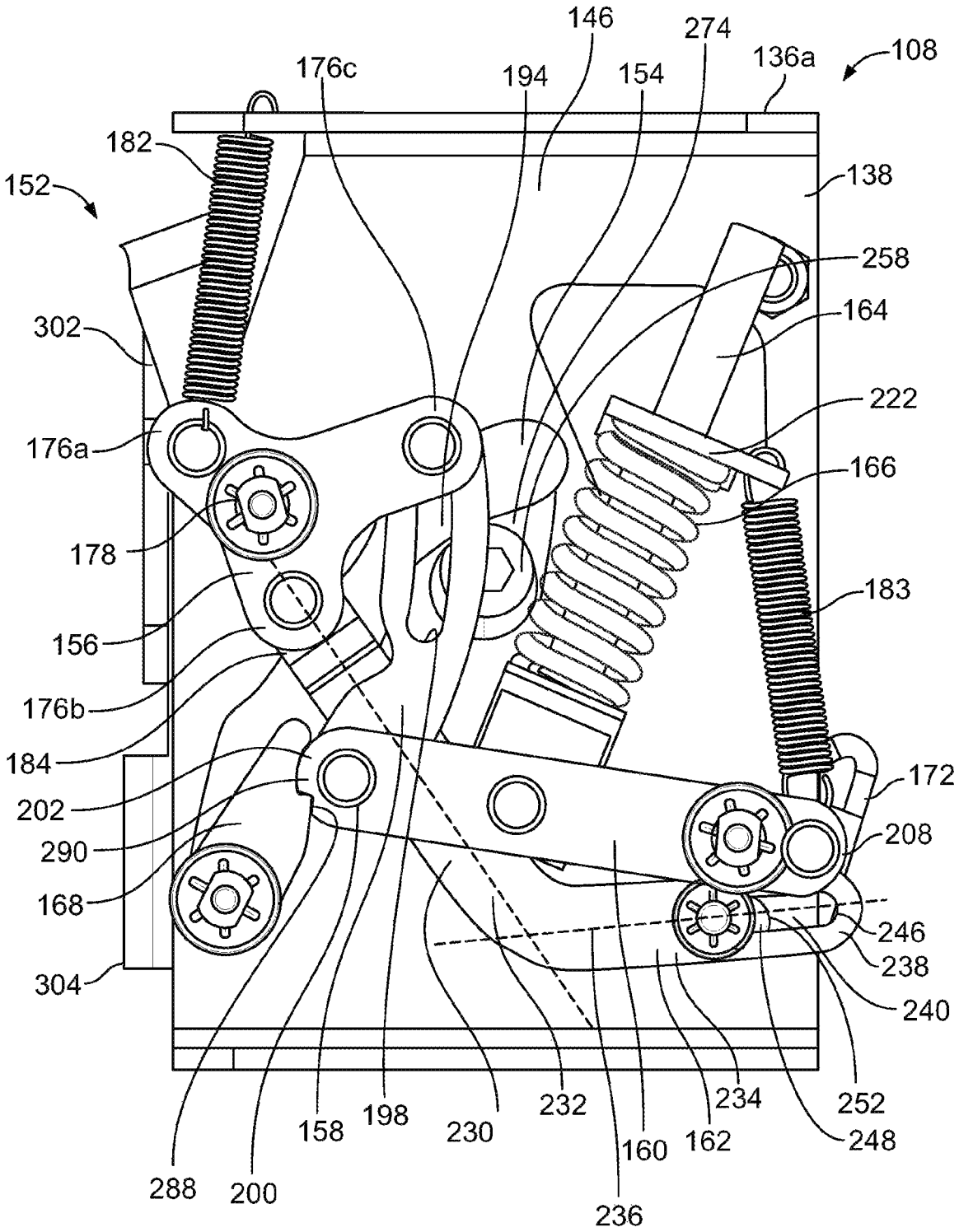
FIG. 15 illustrates a side view of the portion of the exemplary closing mechanism depicted in FIG. 14 in a charged state.

As previously discussed, the second leg 176*b* of the driving fork 156 can be pivotally coupled to a first end 184 of the release link 162. As shown in at least FIG. 15, according to the illustrated embodiment, a first portion 230 of the release link 162 can extend along a first axis 232, while a second portion 234 of the release link 162 extends along a second axis 236, the first and second axes 232, 236 generally intersecting to form an obtuse angle. A second end 238 of the release link 162 can include a generally elongated release slot 240 that is sized to receive insertion of a release pin 242 that is coupled to the release bracket 172. As shown in at least FIGS. 14 and 15, the release slot 240 can extend from a first end 244 to a second end 246. Further, the release pin 242 can be positioned in an elongated bracket slot 250 in the closer bracket 136*a*, 136*b* that extends between a first end 252 and a second end 254, as shown, for example, in FIGS. 14 and 15. As the driving fork 156 is rotated in the first, counterclockwise direction relative to the orientation of the linkage system 152 shown in FIG. 8, the release link 162 is displaced such that the second end 246 of the elongated release slot 240 can contact the release pin 242 and generally linearly displace the release pin 242 toward the first end 250 of the elongated bracket slot 248. Such displacement of the release pin 242 can facilitate rotation of the release bracket 172 about the release bracket shaft 204 in a second, clockwise direction such that the release bracket 172 is displaced from a latch position to an unlatched position in which the release bracket 172 disengaged from a locking engagement with the main bracket 170, as discussed below.

According to the illustrated embodiment, the release bracket 172 includes sidewalls 292 positioned on opposing sides of a body portion 294 of the release bracket 172.

Further, the sidewalls 292 can include apertures through which the release bracket shaft 204 extends, the release bracket 172 being rotatable about the release bracket shaft 204. Additionally, as shown by at least FIGS. 7 and 16, according to the illustrated embodiment, the sidewall 292 can include a leg portion 296 that can extend from each sidewall 292, a portion of each leg portion 296 being positioned within the interior region 150 of the closing mechanism 108. According to the illustrated embodiment, a leg portion 296 is positioned generally adjacent to inner surface 148 of the sidewall 138 of each closer bracket 136*a*, 136*b*. Additionally, each leg portion 296 can include, or be coupled to, the release pin 242 such that displacement of the release pin 242 about at least a portion of the elongated bracket slot 248 can cause rotation of the release bracket 172 about the release bracket shaft 204.

Figure 17:
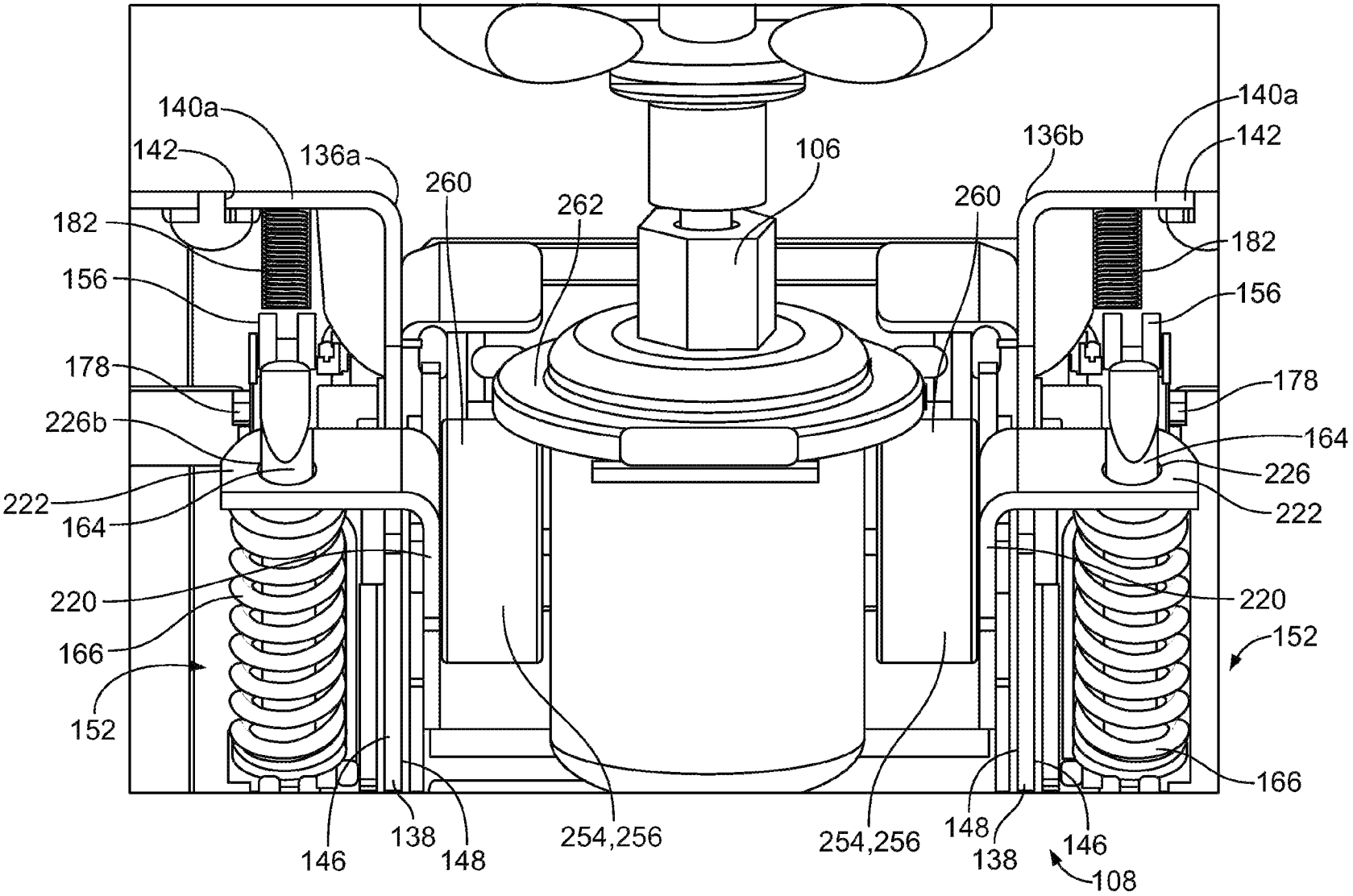
FIG. 17 illustrates a front view of an upper portion of an exemplary closing mechanism in an open, disengaged position relative to at least a pushrod of a recloser.
Figure 18:
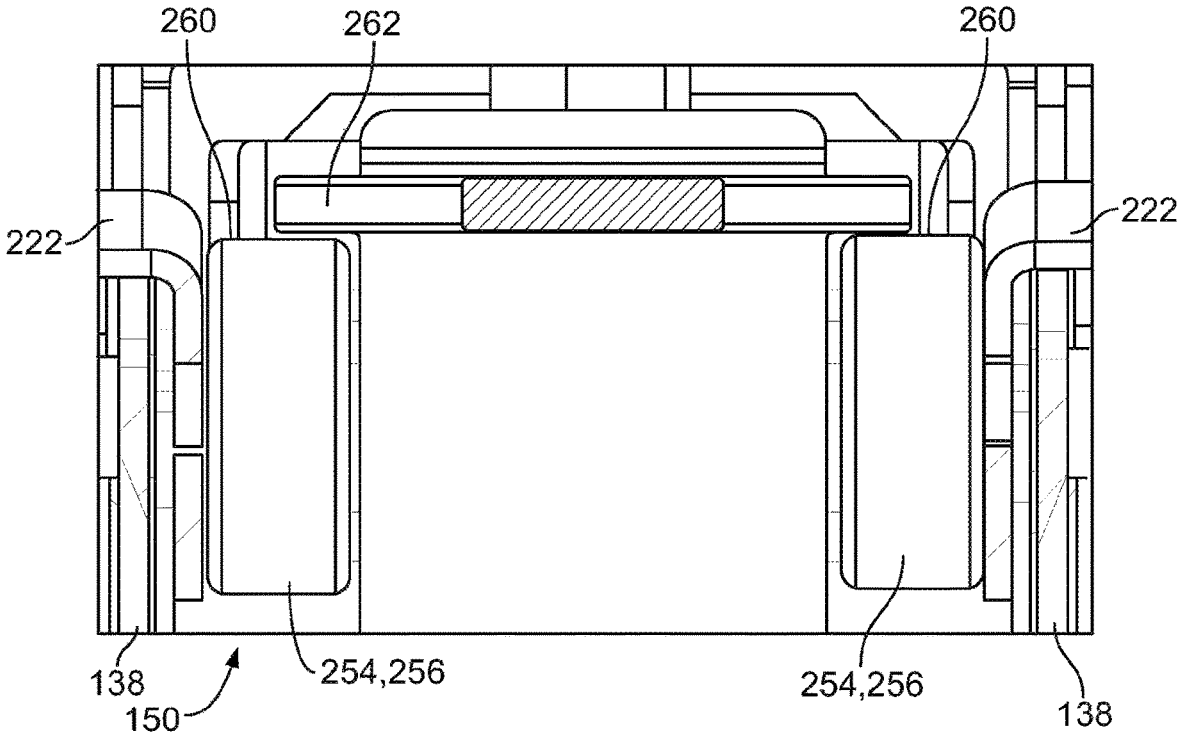
FIG. 18 illustrates a cross sectional front view of an upper portion of an exemplary closing mechanism in a closed, engaged position relative to at least a pushrod of a recloser.
Figure 19:
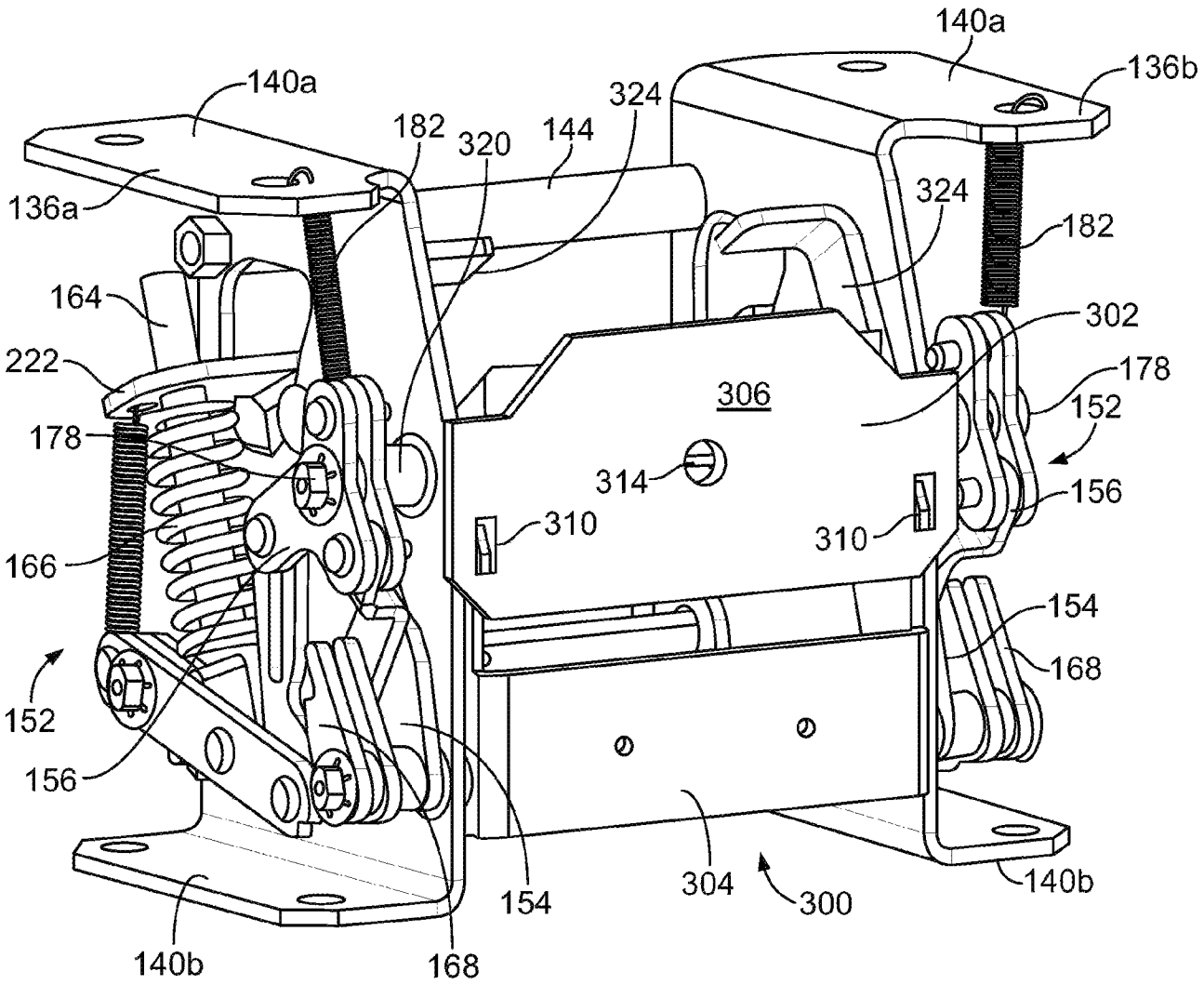
FIG. 19 illustrates a rear side perspective view of an exemplary latch system mounted to an exemplary closing mechanism.

At least a portion of the linkage system 152 is coupled to a closer body 254 that is configured to selectively, via operation of the closing mechanism 108, physically contact and displace the pushrod 106 in manner that facilitates the closing of an open current interrupter 102. According to such an embodiment, when activated, the linkage system 152 can trigger the closer body 254 to be displaced from a first position, as shown in at least FIGS. 11 and 17, to a second position, as shown for example, in FIG. 18, as well as release stored mechanical energy, such that the closer body 254 contacts the pushrod 106 in a manner that displaces the pushrod 106 to a position that can facilitate closing of the open current interrupter 102 as the closer body 254 is displaced to the second position. As discussed below, such displacement of the main bracket 170 and closer body 254, as well as the associated fore to relatively rapidly displace the pushrod 106, can be provided, at least in part, by activation or discharging of the mechanical biasing element 166, and, moreover, provided by a force(s) at least associated with the mechanical biasing element 166 transitioning from a compressed state to a decompressed state.

The closer body 254 can have a variety of different shapes and configurations. For example, according to certain embodiments, the closer body 254 can be a projection that extends from, or is otherwise coupled to, the main bracket 170. According to the illustrated embodiment, the closer body 254 is a roller 256 that is coupled to the sidewall(s) 220 of the main bracket 170, such as, for example, by a closer fastener 258, including, for example, a screw, pin, or bolt, among other fasteners. According to the illustrated embodiment, as the closer body 254 is coupled to the main bracket 170, the displacement of the closer body 254 from the first position to the second position can proceed along a curved or arced path of travel that is generally similar to the rotational movement of the main bracket 170. Thus, in an effort to at least minimize the degree of impact or jolt associated with the closer body 254 being delivered into physical contact with the pushrod 106, at least an outer the portion of the closer body 254, namely a contact surface 260 of the closer body 254, that can come into contact with the pushrod 106 via operation of the closing mechanism 108, and which provides a location for the transmission of the displacement force to the pushrod 106, can have a curved or arced shape. Thus, for example, according to embodiments in which the closer body 254 is a roller, the contact surface 260 can be a portion of the outer circular surface of the roller 256.

According to the illustrated embodiment, when being moved to the second position, the contact surface 260 of the closer body 254 can selectively engage one or more protrusions or projections of the pushrod 106. For example, as shown by at least FIG. 18, according to the illustrated embodiment, the pushrod 106 can include a flange 262 that is generally orthogonal to the central longitudinal axis of the pushrod 106, and, moreover, is generally orthogonal to the direction of travel of the pushrod 106 in the first and second directions, as indicated by directions "D1" and "D2" in FIGS. 13 and 12, respectively. According to the illustrated embodiment, the flange 262 can outwardly extend away from the central longitudinal axis of the pushrod 106 by a distance that provides a clearance away from other relatively adjacent portions of the pushrod 106 such that the closer body 254 can be positioned to be operably moved into contact with the flange 262 without contacting other portions of the pushrod 106.

The main bracket 170 and the release bracket 172 can each include, or be coupled to, portions of a main latch 264 that is configured to selectively lockingly engage the main bracket 170 to the release bracket 172. For example, according to the illustrated embodiment, an upper latch member or portion 266 of the main latch 264 that extends from a lower wall 268 of the bracket body 218 of the main bracket 170 can matingly engage a lower latch member or portion 270 of the main latch 264 that extends from an upper wall 272 of the release bracket 172. According to the illustrated embodiment, the upper and lower latch members 266, 270 are curved shaped projections, extensions, hooks, and/or arms, among other configurations or components, that can lockingly engage each other when the closing mechanism 108 is at least in a charged state or condition. As shown in at least FIG. 16, according to certain embodiments, inner surfaces of the upper and lower latch members 266, 270 can lockingly engage each other. Such locking engagement can retain the main bracket 170 at a position associated with the closer body 254 being at the above-discussed first position, as shown, for example, by FIG. 11. However, as discussed below, at least when the closer body 254 is to be released from the first position, and, moreover, when the closer body 254 is to move to the second position so as to facilitate displacement of the pushrod 106 to a position that closes the opened current interrupter 102, the release bracket 172 can be displaced away from the main bracket 170 in a manner that separates the lower latch member 270 from the upper latch member 266. For example, with respect to at least the orientation depicted in FIG. 8, as the release bracket 172 is rotated in the first, counterclockwise direction about the release bracket shaft 204, the lower latch member 270 can be displaced to a position that no longer engages the upper latch member 266, thereby unlocking the main latch 264. With the main latch 264 unlocked, the lower latch member 270 is not positioned to prevent the operable displacement of the main bracket 170, and the main bracket 170 can be rotably displaced such that the closer body 254 can be displaced to the second position, as shown, for example, by FIG. 18.

As the main bracket 170 is rotably displaced such that the closer body 254 can be displaced to the second position, the closer fastener 258 or other projection or protrusion extending from or otherwise coupled to the main bracket 170 is similarly rotably displaced. As shown by at least FIGS. 8, 14, and 15, according to the illustrated embodiment the closer fastener 258 extends through an aperture 274 in the sidewall 138 of the closer bracket 136*a*, 136*b*. Moreover, the aperture 274 can be sized to accommodate movement of the closer fastener 258 associated with the displacement of the main bracket 170. Further, as the closer fastener 258 is displaced via displacement of the main bracket 170, the closer fastener 258 can slidingly engage the secondary latch lever 154 such that the closer fastener 258 exerts a force against the secondary latch lever 154, such as, for example, along or around a portion of the secondary latch lever 154, in the general vicinity of the first end 276 of the secondary latch lever 154. As the closer fastener 258 is moved with the displacement of the main bracket 170, the force exerted by the closer fastener 258 on the secondary latch lever 154 can cause the secondary latch lever 154 to rotate. Moreover, a second end 278 of the secondary latch lever 154 can be securely coupled to a lever spindle 280 that is coupled to the sidewall 138 of the adjacent closer bracket 136*a*, 136*b* and/or the close latch 168. Accordingly, the displacement of the closer fastener 258 can, via at least engagement of the closer fastener 258 with the latch lever 154, cause the secondary latch lever 154 to rotate generally about a central longitudinal axis 284 (FIG. 16) of the lever spindle 280, and cause similar rotational displacement of at least the lever spindle 280.

The lever spindle 280 can also be coupled to a second end 282 (FIG. 16) of the close latch 168 such that rotation of the lever spindle 280 can facilitate rotatable displacement of the close latch 168 generally in the same direction. According to the illustrated embodiment, a first end 284 of the close latch 168 can include a groove or recess 286 having a shape that can facilitate the close latch 168 selectively lockingly engaging at least a portion of the first end 202 of the spring arm 160. Further, according to certain embodiments, in an effort to facilitate the locking engagement between the close latch 168 and the spring arm 160, the first end 202 of the spring arm 160 can also include a groove or recess 288 (FIG. 8) and/or a corresponding projection or protrusion 290 (FIG. 10) that provides the spring arm 160 with a shape that can enhance the selective locking engagement between the close latch 168 and the spring arm 160. Additionally, according to certain embodiments, a mechanical biasing element, such as, for example a torsion spring, among other biasing elements, can be operably coupled to the close latch 68 in a manner that biases the close latch 168 to a position at which the close latch 168 can lockingly engage the spring arm 160. For example, according to certain embodiments, a torsion spring can be coupled to, or otherwise in operable engagement with, the lever spindle 280 such that the torsion spring provides a force that seeks to bias the close latch 168 to a position that facilitates locking engagement of the close latch 168 with the spring arm 160. For example, with respect to the orientation of the linkage system 152 depicted in FIG. 8, the torsion spring can provide a force that generally biases the close latch 168 in the clockwise, or second, rotational direction, as indicated by the rotational direction "$R_2$" in FIG. 8.

As discussed below, when the closing mechanism 108 is in a charged state, a portion of the spring arm 160 can be lockingly engaged with the close latch 168. For example, as shown in at least FIG. 15, when the closing mechanism 108 is in the charged state, the close latch 168 can be at an angular orientation such that close latch 168 engages the spring 160 in a manner that prevents the spring arm 160 from rotating in the counterclockwise direction. However, as illustrated by at least FIG. 14, upon rotation of the close latch 168 in the counterclockwise direction, such as, for example, upon rotation of the lever spindle 280 via displacement of the secondary latch lever 154 when the closing mechanism 108 is changing from the charged state to the discharged state, the close latch 168 may disengage from the locking engagement with the spring arm 160, and thus the spring arm 160 can, at least with respect to the orientation of the linkage system 152 depicted in FIG. 8, be rotated in the first, counterclockwise direction.

Referencing FIGS. 19-23B, the closing mechanism 108 can include, or otherwise be coupled to, a latch system 300 that is connected to the second, lower terminal 116. According to certain embodiments, the latch system 300 can also be coupled to the linkage system 152 of the closing mechanism 108. According to the illustrated embodiment, the latch system 300 can include a lower terminal latch plate 302 and a lower terminal latch 304.

The lower terminal latch plate 302 includes a plate portion 306 and one or more latch plate arms 308. The plate portion 306 can comprise one or more plates that generally extend from, or between, the closer brackets 136*a*, 136*b* of the closing mechanism 108. According to certain embodiments, at least a portion of the plate portion 306 can be sized and/or positioned to abut an end surface 137 of the closer brackets 136*a*, 136*b*, as shown, for example, in FIG. 20, such that the closer brackets 136*a*, 136*b* provide a stop or barrier that limits the degree to which the lower terminal latch plate 302 can be rotably displaced in at least one, if not both, rotational directions.

Figure 23A:
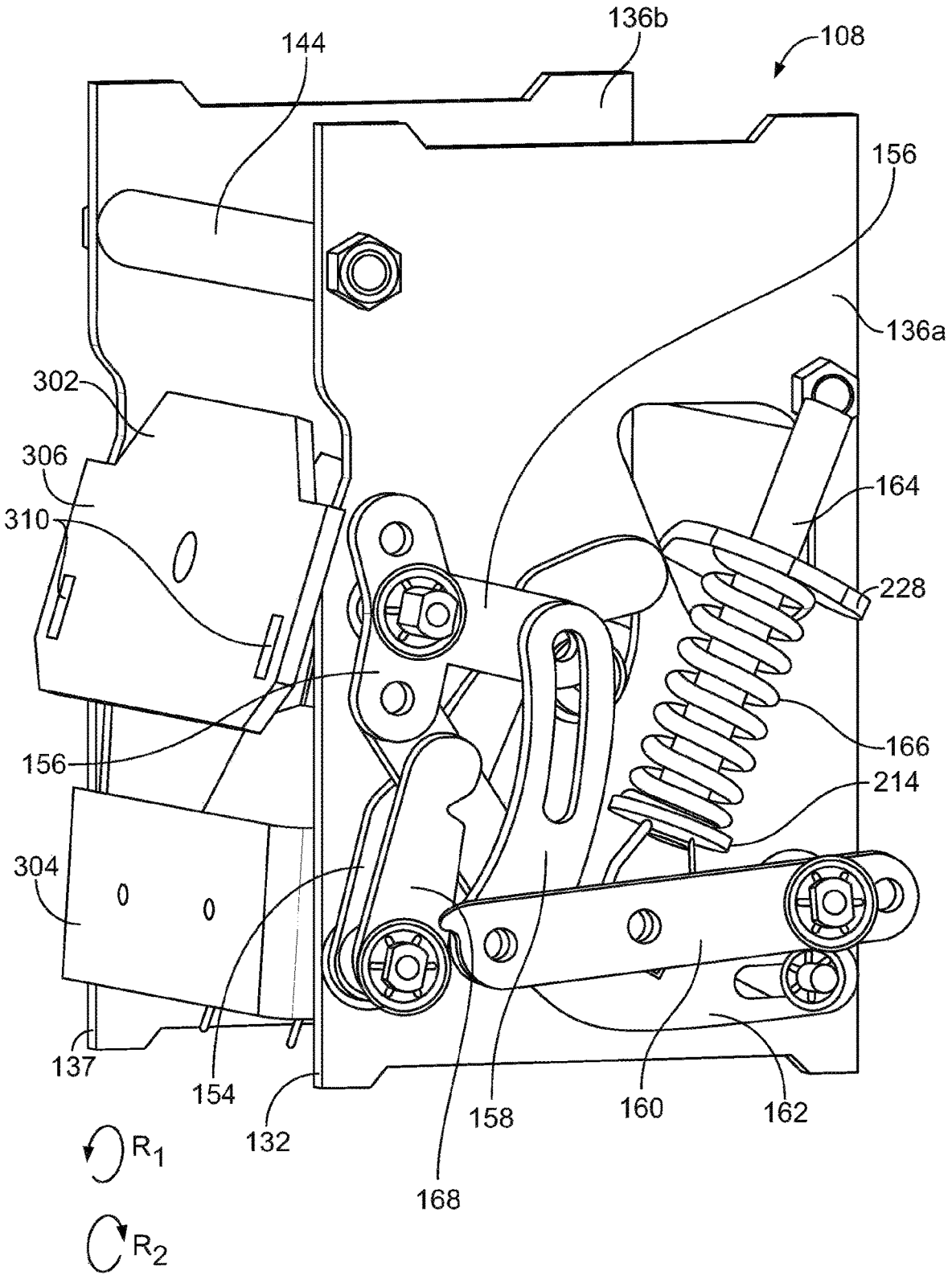
FIG. 23A illustrates a side view of both a lower terminal latch plate of an exemplary latch system in a first, raised position and an exemplary closing mechanism in the uncharged state.
Figure 23B:
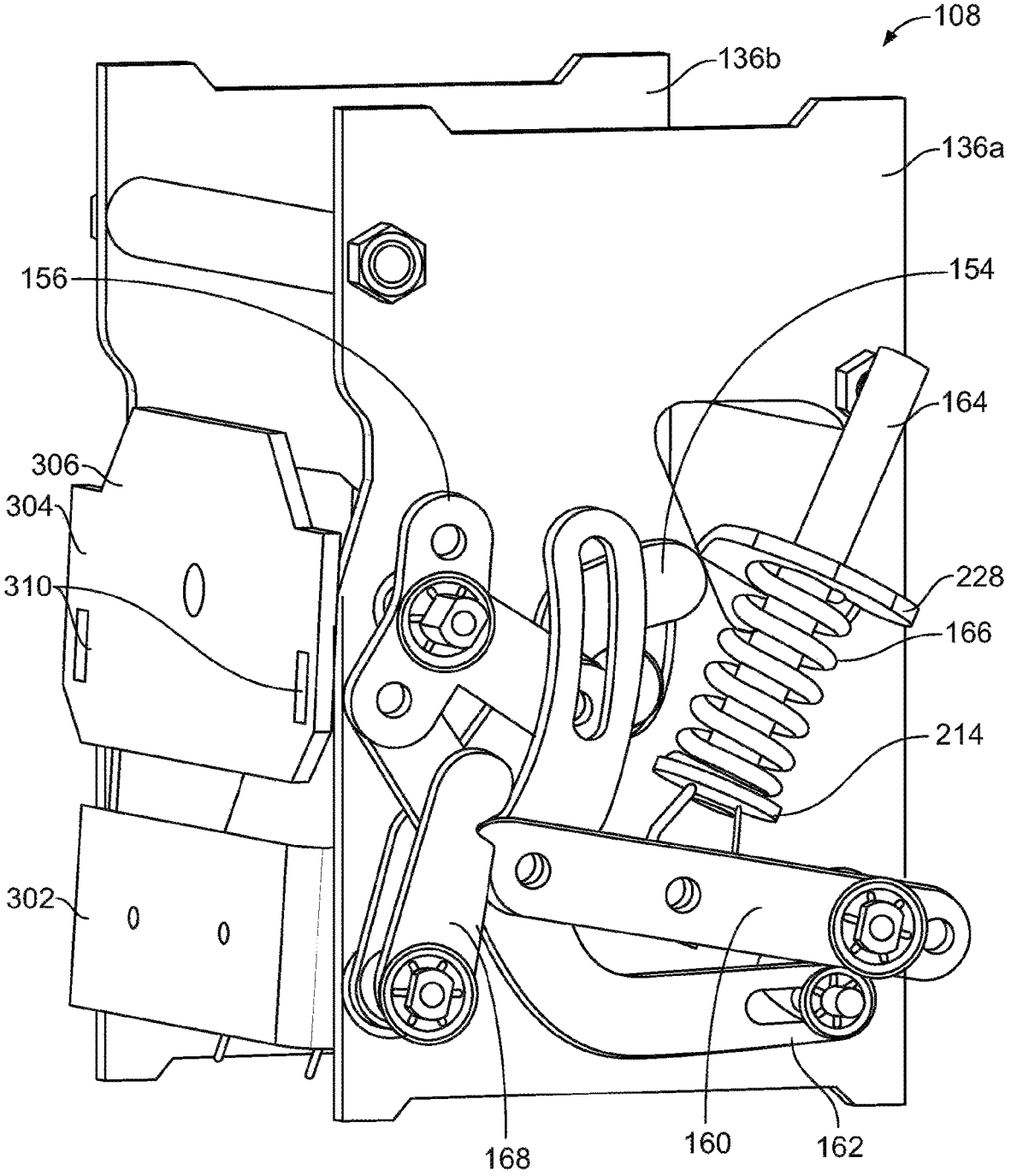
FIG. 23B illustrates a side view of both a lower terminal latch plate of an exemplary latch system in a second, lowered position and an exemplary closing mechanism in the charged state.
Figure 24:
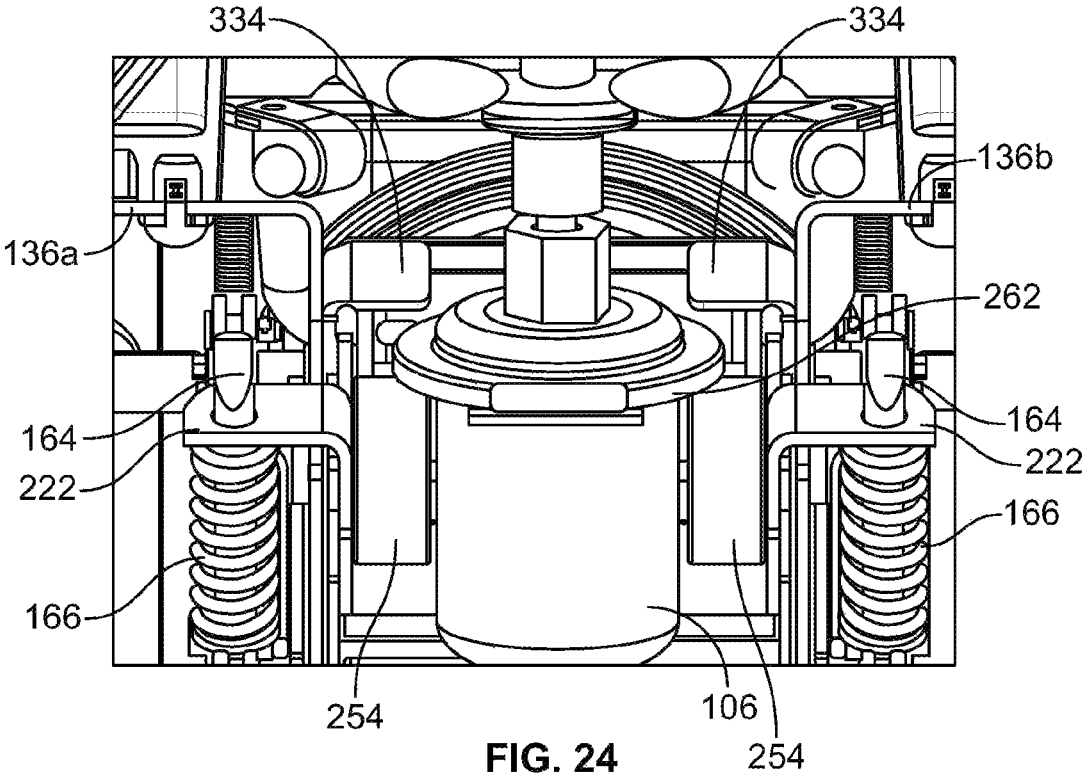
FIG. 24 illustrates a front side view of a portion of the exemplary recloser depicted in FIG. 2.

The plate portion 306 can further include one or more apertures 310 that are each configured to receive placement of a latch body 312 of the lower terminal latch 304 in connection with locking the lower terminal latch plate 302 in at least one of the first, raised position, as shown in FIG. 23A, and the second, lowered position, as shown in FIG. 23B. Additionally, as shown by at least FIGS. 19 and 20, the plate portion 306 can also include an opening 314 that can be configured to receive a mechanical fastener 316 (FIG. 22B) for securing the lower main terminal 46 of the second, lower terminal 116 to the plate portion 306, and/or which can be coupled to, or receive, a portion of the second connector 60 that is coupled to the current transformer 40 and which is used to deliver electrical current to the second, lower terminal 116.

Figure 21:
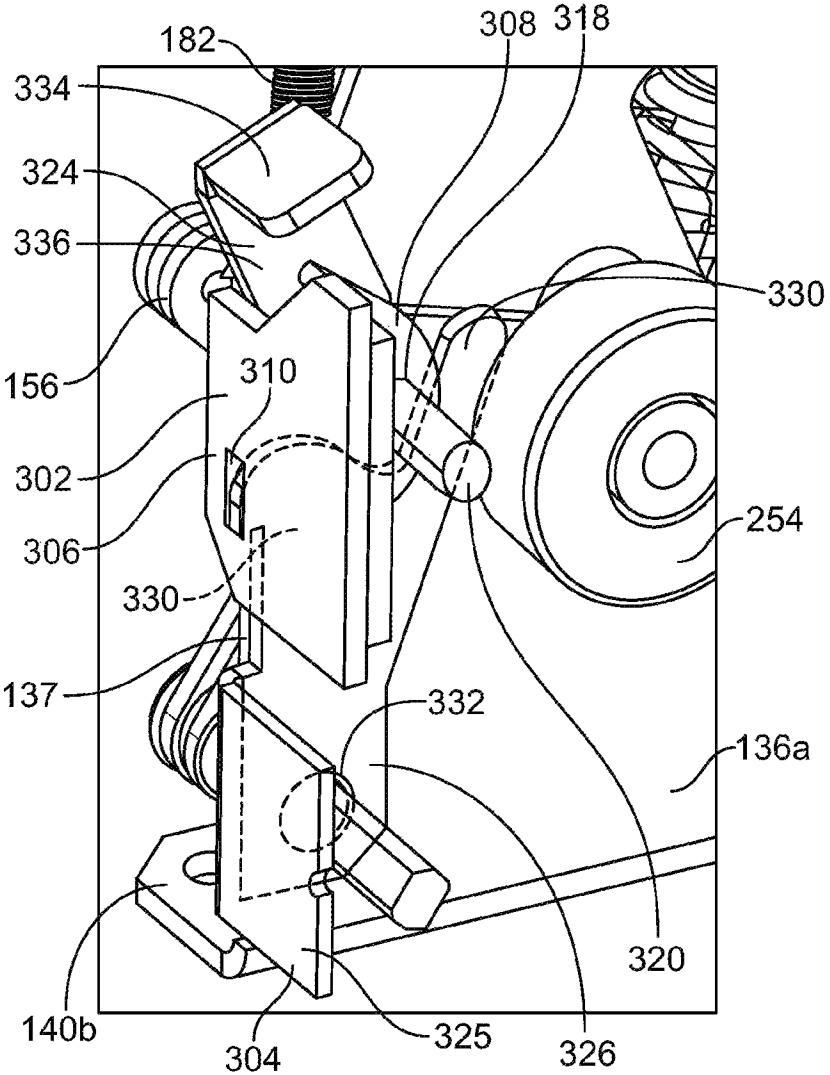
FIG. 21 illustrates a rear side cutaway view of a portion of the exemplary latch system and closing mechanism depicted in FIG. 19.
Figure 20:
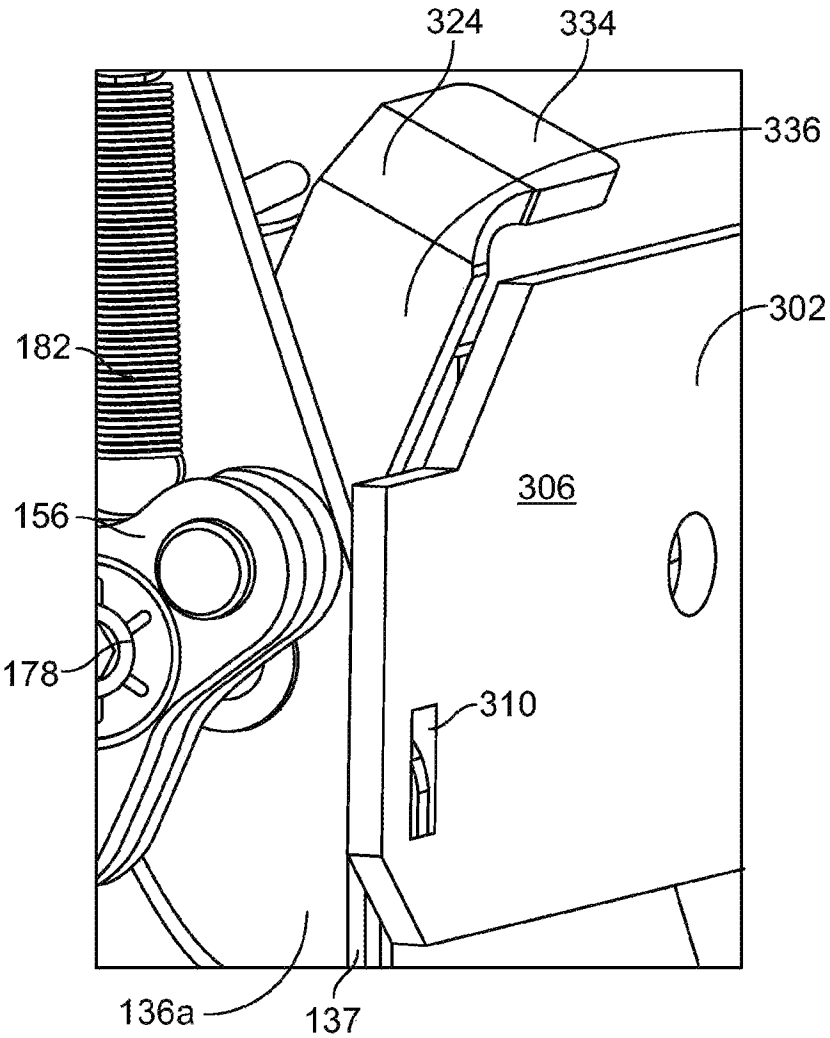
FIG. 20 illustrates a rear side perspective view of a portion of the exemplary latch system and closing mechanism depicted in FIG. 19.
Figure 22A:
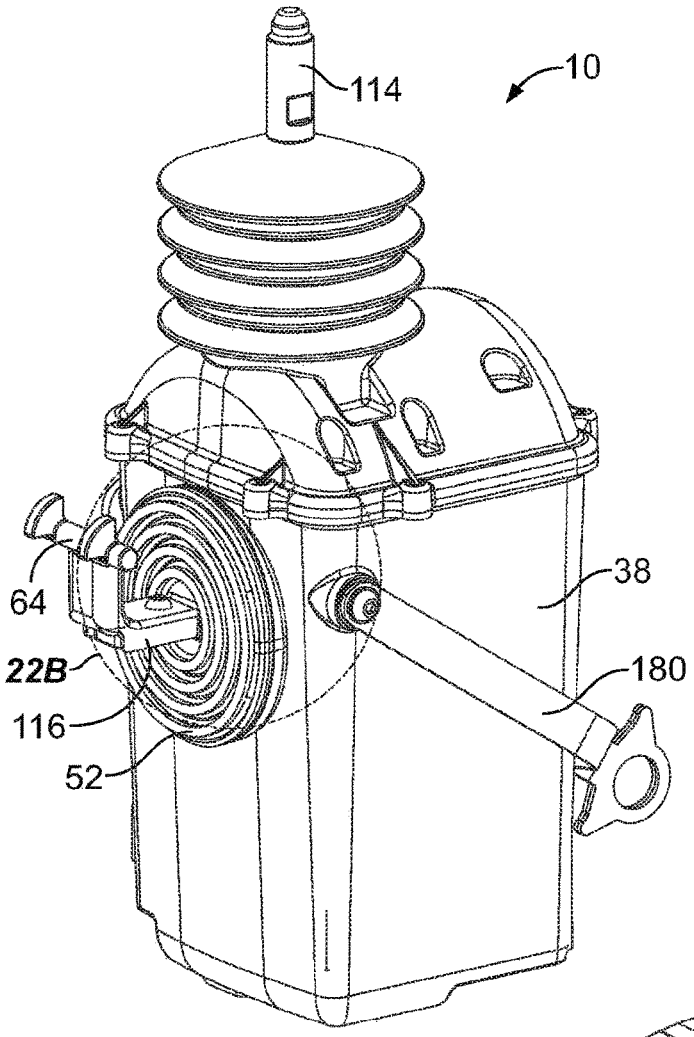
FIG. 22A illustrates a rear side perspective view exemplary recloser depicted in FIG. 19.
Figure 22B:
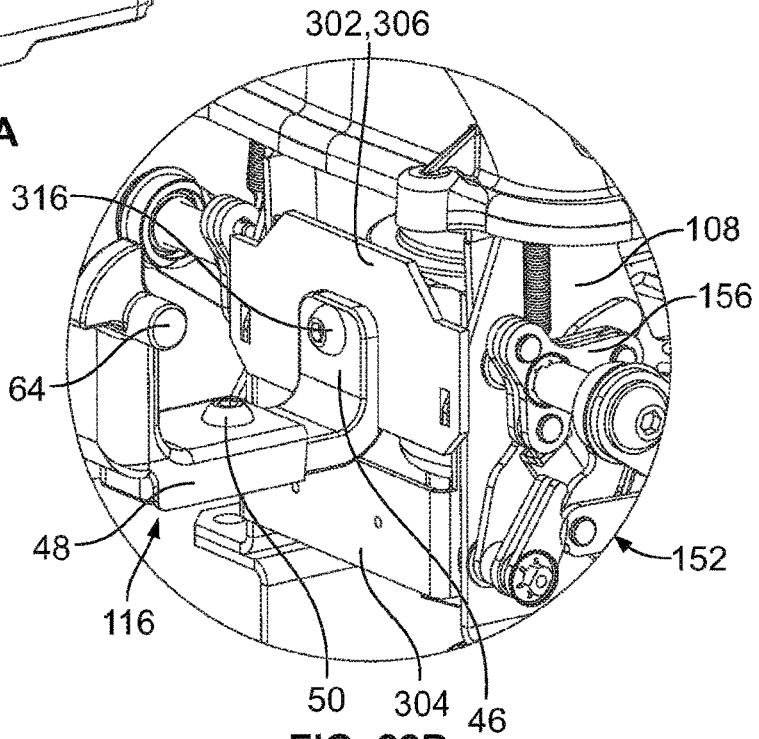
FIG. 22B illustrates a cutaway view of the portion of the exemplary recloser designated within circle "A" in FIG. 22A.

According to the illustrated embodiment, the lower terminal latch plate 302 includes a pair of opposing latch plate arms 308, each latch plate arm 308 extending from opposing ends of the plate portion 306. While FIG. 21 illustrates a single latch plate arm 308 from one end of the plate portion 306, another latch plate arm 308 at the opposite end of the plate portion 306 can have a similar configuration. Each latch plate arm 308 of the lower terminal latch plate 302 can include an orifice 318 that can accommodate pivotable displacement of the lower terminal latch plate 302 about a driven shaft 320 between the first, raised position, and the second, lowered position, as shown in FIGS. 23A and 23B, respectively. Further, according to certain embodiments, the lower terminal latch plate 302 can be biased to the first, raised position, such as, for example, via a biasing force(s) provided by one or more mechanical biasing elements, including, but not limited to, one or more springs.

According to the illustrated embodiment, the driven shaft 320, about which the lower terminal latch plate 302 can rotate, can include, be, or be coupled to the driven hub 178. Thus, the driven shaft 320 can generally be directly rotated via rotation of the driver 180 when the driver 180 is operably engaged with the driven hub 178. Further, according to certain embodiments, the driving fork 156 can be mounted to the driven shaft 320 in a manner that facilitates rotation of the driving fork 156 as the driven shaft 320 is rotated. Thus, according to certain embodiments, the driven shaft 320 provides the central axis 174 (FIG. 7) about which the driving fork 156 can rotate.

As shown in at least FIG. 21, at least portions of the driven shaft 320 can have a non-round outer shape, including, for example, an outer shape that includes one or more flattened surfaces. The driving fork 156 can have a similar, mating shape such that the driving fork 156 can be rotated directly via rotation of the driven shaft 320. However, according to certain embodiments, the orifices 318 of the latch plate arms 308 of the lower terminal latch plate 302 can have a shape, such as, for example, a round shape, such that the lower terminal latch plate 302 is not directly rotated via rotation of the driven shaft 320. Instead, as discussed below, the lower terminal latch plate 302 can be rotated between the first, raised position (FIG. 23A) and the second, lowered position (FIG. 23B) in response to the application of a force against the lower terminal latch plate 302 transmitted by to the lower terminal latch plate 302 via the rotational displacement of one or more latch release brackets 324 that are rotably displaced by the driven shaft 320.

The lower terminal latch 304 includes a latch panel 325 and at least one latch arm 326, each latch arm 326 having a lever portion 328 and a latch portion 330. The latch portion 330 can include the one or more of the previously discussed latch bodies 312 that are configured to be received in an aperture 310 in the plate portion 306 of the lower terminal latch plate 302 in a manner that can at least assist in securing the lower terminal latch plate 302 in at least one of the first, raised position and the second, lowered position.

The lower terminal latch 304 can be rotated about the lever spindle 280. For example, the latch arm(s) 326 can include an orifice 332 that is sized to receive placement of at least a portion of the lever spindle 280. However, unlike the close latch 168 and the secondary latch lever 154, according to certain embodiments, the lower terminal latch 304 can be rotated about the lever spindle 280 independent of the rotation, if any, of the lever spindle 280. Thus, according to certain embodiments, the outer surface lever spindle 280 can include one or more non-round shapes, such as, for example, one or more flat sides, and the close latch 168 and the secondary latch lever 154 similar shaped mating openings, while the orifice(s) 332 of the latch arm(s) 326 can have a generally rounded shape so that the lower terminal latch 304 is not directly rotated by rotation of the lever spindle 280.

According to certain embodiments, the lower terminal latch 304 can be biased in a direction that facilitates the lower terminal latch 304 lockingly engaging the lower terminal latch plate 302 at least when the lower terminal latch plate 302 is at the second, lowered position. For example, referencing the orientation of at least the latch system 300 depicted in FIG. 23A, the lower terminal latch 304 generally rotates in a first rotational direction (as designated by "$R_1$" in FIG. 23A) as the lower terminal latch plate 302 is displaced from the first, raised position (FIG. 23A) to the second, lowered position (FIG. 23B). Thus, according to certain embodiments, the lower terminal latch 304 can be biased in the first rotational direction such that, when the lower terminal latch plate 302 is displaced to the second, lowered position, the lower terminal latch 304 is also similarly displaced so that the lower terminal latch 304 can at least assist in securing the lower terminal latch plate 302 at the second, lowered position. As previously discussed, such latching or securing of the lower terminal latch plate 302 can include the latch body(ies) 312 of the lower terminal latch 304 being inserted into the aperture(s) 310 of the lower terminal latch plate 302 while the lower terminal latch plate 302 is at the second, lowered position.

Such biasing of the lower terminal latch 304 can be attained in a variety of different manners, including, for example, via the use of one or more mechanical biasing elements, such as, but not limited to, one or more springs. For example, according to certain embodiments, the lower terminal latch 304 can be biased in the first rotational direction (as designated by "$R_1$" in FIG. 23A) by a first end of a torsional spring, while a second end of the torsional spring can bias a close latch 168 of a generally adjacent linkage system 152 in the second, opposite rotational direction (as designated by "$R_2$" in FIG. 23A).

Figure 25:
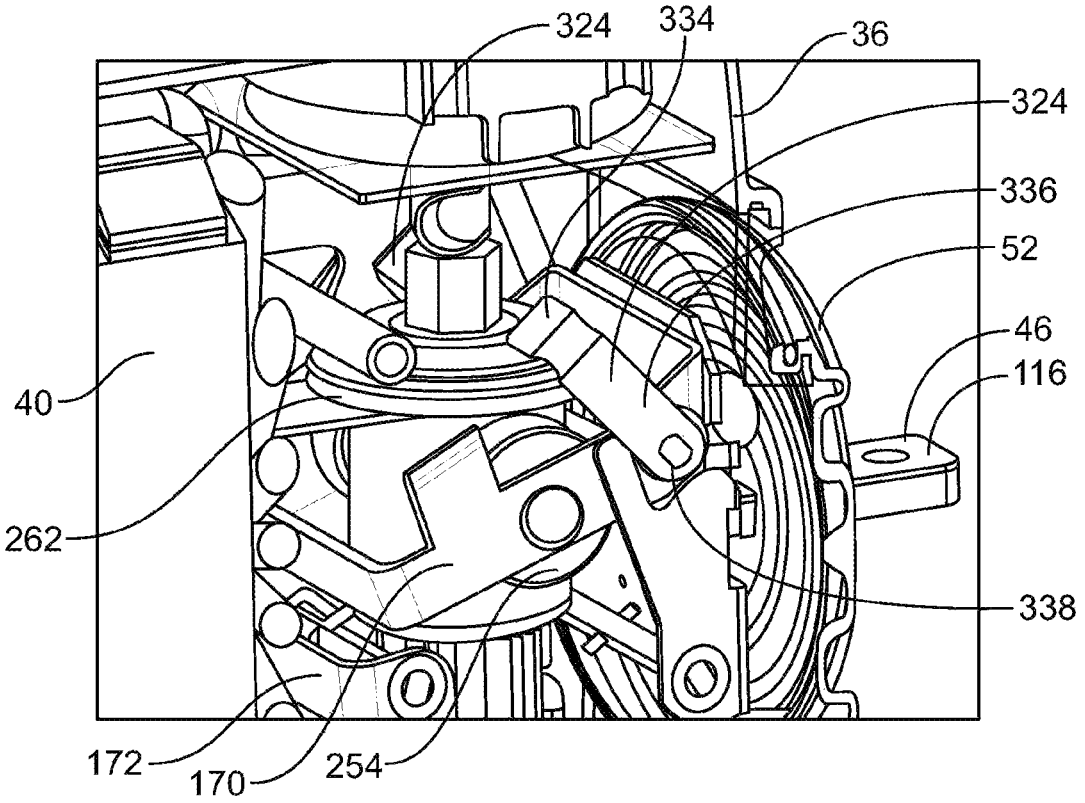
FIG. 25 illustrates a cutaway side view of a portion of the exemplary recloser depicted in FIG. 2.

Referencing FIGS. 20, 21, 24, and 25, according to the illustrated embodiments, the one or more latch release brackets 324 can generally have an "L" shape, and be pivotally displaceable between a first position and a second position via rotation of the driven shaft 320. Moreover, according to the illustrated embodiment, each latch release bracket 324 can have an upper portion 334 and a lower portion 336, the upper portion 334 being generally orthogonal to the lower portion 336 and oriented relative to the closing mechanism 108 so as to be in a generally inwardly extending direction toward the interior region 150 of the closing mechanism 108. The lower portion 336 of the release bracket 324 can include an orifice 338 (FIG. 25) that matingly engages the driven shaft 320. For example, as shown in FIG. 25, the orifice 338 of the release bracket 324 can have a non-round shape similar to the shape of the driven shaft 320 such that the latch release bracket(s) 324 can be directly rotated between the first position and the second position via rotation of the driven shaft 320. Accordingly, the direction of rotation of the latch release bracket(s) 324 can, according to certain embodiments, be dependent on the direction of rotation of the driven shaft 320.

According to the illustrated embodiment, rotation of the driven shaft 320 in the first rotational direction (as indicted by "$R_1$" in FIG. 23A), which can coincide with similar rotation of the driving fork 156 in connection with charging of the closing mechanism 108, as previously discussed, can facilitate a portion of the lower portion 336 of the latch release bracket(s) 324 contacting, and exerting a force against, the lower terminal latch plate 302. Such rotation, and the associated force, by the release bracket(s) 324 against the lower terminal latch plate 302 can facilitate similar rotational displacement of the lower terminal latch plate 302 from the first, raised position to the second, lowered position.

Similarly, as the second, lower terminal 116 is coupled to the lower terminal latch plate 302, the lowering of the position of the lower terminal latch plate 302 can also result in the second, lower terminal 116 also being displaced from its first, raised position, as shown, for example, in FIG. 26B, to a second, lowered position, as shown, for example, by FIG. 26C, and as discussed below. Such displacement of the second, lower terminal 116 can also be accommodated by the flexible nature of the lower terminal gasket 54, which can bend, deform, and/or be deflected to accommodate such displacement of the second, lower terminal 116.

Further, the displacement of the lower terminal latch plate 302 to the second, lowered position can, according to at least certain embodiments, coincide with similar rotational displacement of the lower terminal latch 304, such as, for example, via biasing forces exerted against the lower terminal latch 304. Again, such displacement of the lower terminal latch 304 can facilitate a latching engagement between the lower terminal latch 304 and the lower terminal latch plate 302 that is configured to maintain the lower terminal latch plate 302, and thus the second, lower terminal 116, at their respective second, lowered positions.

Conversely, when the latch release bracket 324 is rotated in the second rotational direction, and the lower terminal latch plate 302 is latched in the second, lowered position, the latch release bracket(s) 324 can exert a force against at least a portion of the pushrod 106 in a manner that can at least partially assist in the manual opening of current interrupter 102. For example, referencing FIGS. 24 and 25, according to certain embodiments, when being rotated in the second rotational direction, a portion of the upper portion 334 of the latch release bracket(s) 324 can engage an upper surface of the flange 262 that is generally on a side of the flange 262 that is opposite to the surfaces of the flange 262 that are contacted by the closer body(ies) 254. With the upper position 334 of the latch release bracket(s) 324 engaged with the flange 262, as the latch release bracket(s) 324 is/are continued to be rotated in the second rotational direction via rotation of the driven shaft 320, the upper portion 334 of the latch release bracket(s) 324 can provide a force against the pushrod 106, and moreover, against the flange 262, that attempts to displace the pushrod 106 generally in the first direction (as indicated by direction "$D_1$" in FIG. 13) so as to facilitate the manual opening of the recloser 10, and more specifically, the opening of a closed current interrupter 102.

For example, according to certain embodiments, when the current interrupter 102, and thus the recloser 10, is in the closed position, the electromagnetic actuator 104 can generate a magnetic field, such as, for example, via use of the primary coils 12 of the electromagnetic actuator 104, that seeks to attract an armature 126 of the electromagnetic actuator 104 that is coupled to the pushrod 106 at a position in relative close proximity to those primary coils 128. When the latch release bracket(s) 324 is rotated in the second rotational direction and in contact with the pushrod 106, the force exerted by the upper portion 334 of the latch release bracket(s) 324 on the pushrod 106 can be sufficient to displace the pushrod 106 a distance in the first direction (as indicated by direction "$D_1$" in FIG. 13) that increases a distance between the armature 126 and the primary coils 128 in the electromagnetic actuator 104. Such an increase in distance between the armature 126 and the primary coils 128, can result in a decrease in the attractive magnetic force that the primary coils 128 had been exerting against, or which is otherwise being experienced by, the armature 126. Such a reduction in the magnetic force being exerted against the armature 126 can result in other components of the recloser 10, pushrod 106, and/or electromagnetic actuator 104 providing a sufficient force against the armature 126, pushrod 106, or other related component that overcomes the reduced and can facilitate continued displacement of the pushrod 106 in the first direction to a position that causes the opening of the current interrupter 102. Additionally, according to certain embodiments, such further displacement of the pushrod 106 after the attractive magnetic forces being experienced by the armature 126 have been reduced, can be with, or in the absence of, additional forces being provided against the pushrod 106 via the continued displacement of the latch release bracket(s) 324. While the foregoing example of manually opening a closer interrupter 102 has been described in the context of a particular electromagnetic actuator 104 configuration, the manual opening of the current interrupter 102 using, at least in part, the transmission of forces from the rotational displacement of the latch release bracket(s) 324 can be occur in a variety of other manners for different types of actuators.

Additionally, the continued rotation of at least the latch release bracket 324 in the second rotational direction, including, for example, rotation beyond a position that facilitated the manual opening of the closed current interrupter 102, can facilitate the release of the latched engagement between the lower terminal latch plate 302 and the lower terminal latch 304 of the latch system 300. Such releasing of the latched engagement can facilitate the lower terminal latch plate 302, as well as the second, lower terminal 116, being rotated in the second rotational direction from their respective second, lowered positions to their first, raised positions. More specifically, as the latch release bracket 324 continues to be displaced in the second rotational direction, the latch release bracket 324 can contact the adjacent lever portion 328 of the latch arm 326 of the lower terminal latch 304 to facilitate rotation of the lower terminal latch 304 in the second rotational direction. Such displacement of the lower terminal latch 304 can unlatch the lower terminal latch 304 from the lower terminal latch plate 302, including, for example, facilitate the removal of the latch body(ies) 312 from the corresponding aperture(s) 310 of the lower terminal latch plate 302. With the lower terminal latch plate 302 unlatched from the lower terminal latch 304, the lower terminal latch 304 no longer precludes the lower terminal latch plate 302 from being rotated back from the second, lowered position to the first, raised position. Therefore, forces exerted on the lower terminal latch plate 302, including, for example, biasing forces from associated mechanical biasing elements, as well as gravitational forces when the recloser 10 is latched to the cutout 12, can facilitate the lower terminal latch plate 302 being rotated back to the first, raised position. Further, again, as the second, lower terminal 116 is coupled to the lower terminal latch plate 302, the second, lower terminal 116 can also be raised to its first, raised position with the raising of the lower terminal latch plate 302 to the first, raised position.

FIGS. 26A-26G illustrate various stages of the latching an open exemplary cutout mountable recloser 10 to a cutout 12, as well as subsequent closing of the latched recloser 10, re-opening of the latched recloser 10, and unlatching of the recloser 10 from the cutout 12. The below discussed stages include installing, as well as latching, the recloser 10 in the cutout 12 while the recloser 10, and moreover the current interrupter 102, is in the open condition, thereby at least enhancing the safety of the installation, and more specifically, minimizing the potential for arcing while an installer is securing the recloser 10 to the cutout 12. Further, as discussed below, the recloser 10 can remain in latched to the cutout 12 both when placed in a closed condition, and if subsequently placed in the opened condition in response to one or more fault currents and/or in association with operation of the recloser. More specifically, the recloser 10 can remain latched to recloser 12, including after completion of reclosing operations, until an operator or other individual manipulates the driver 180 to facilitate at least unlatching of the recloser 10 from the cutout 12.

Figure 26A:
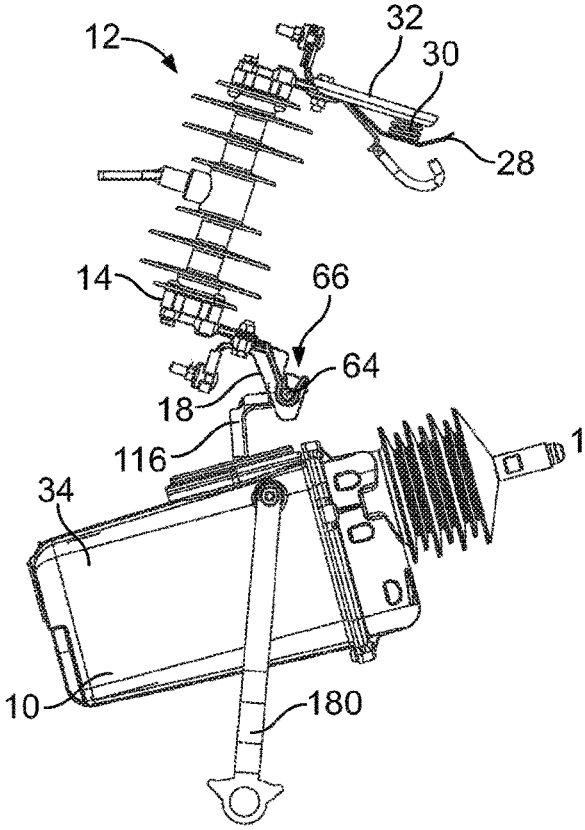
FIGS. 26A-26G illustrate various stages of latching an open exemplary cutout mountable recloser to a cutout, as well as subsequent closing of the latched recloser, re-opening of the latched recloser, and unlatching of the recloser from the cutout.
Figure 27:
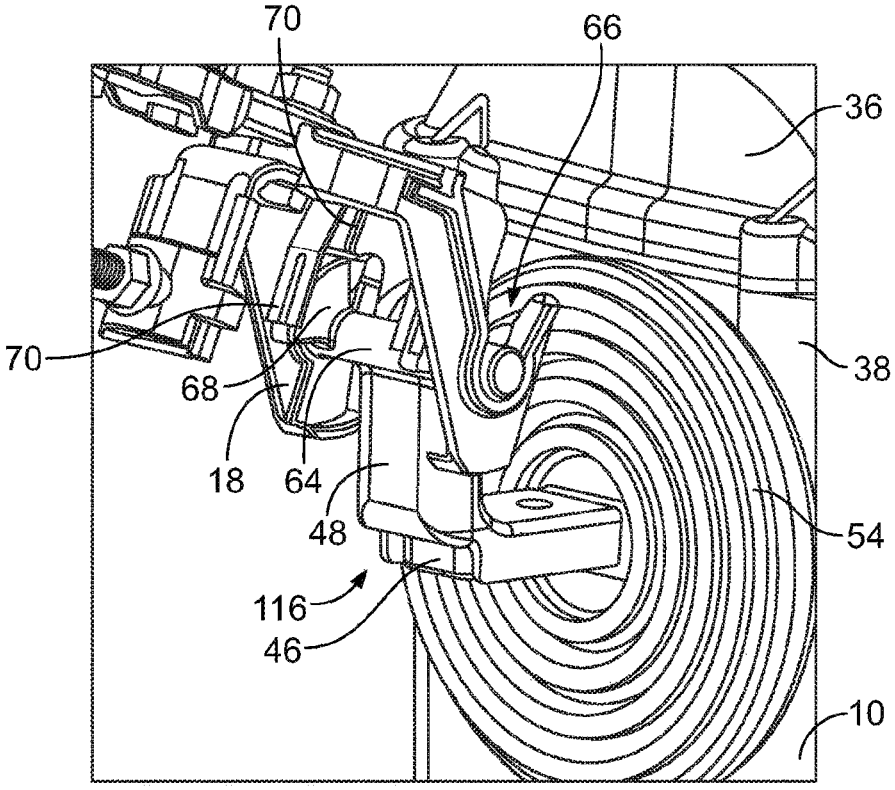
FIG. 27 illustrates a second, lower terminal of an exemplary cutout mountable recloser being coupled to a lower hinge support of a cutout.

At stage 1, as shown in FIG. 26A, with the recloser 10 in an open condition, and, more specifically, the current interrupter 102 opened, the lower terminal trunnion 48 can be placed into engagement with the lower hinge support 18 of the cutout 12. For example, as shown in at least FIGS. 26A and 27, a shaft 64 of the lower terminal trunnion 48 can be received in a slot 66 of the lower hinge support 18 such that the recloser 10 can at least temporarily hang from the lower hinge support 18. Additionally, the shaft 64 can be sized and configured for rotatable displacement within the slot 66 such that the angular orientation of the recloser 10 can be adjusted relative to at least the cutout 12. Further, as the recloser 10 is rotated into position relative to the cutout 12, the shaft 64 or other portions of the lower terminal trunnion 48 can become securely or lockingly engaged with at least a portion of the lower hinge support 18 so as to prevent, at least when the recloser 10 is latched to the cutout 12, the lower terminal trunnion 48 from being disengaged with the lower hinge support 18. For example, as the recloser 10 is rotated relative to the cutout 12, and the shaft 64 is thus rowed about the slot 66, the shaft 64 or other generally adjacent portions of the lower terminal trunnion 48, such as, for example, a protrusion 68, as shown in FIG. 27, of the shaft 64 can become engaged and/or positioned relative to one or more extensions or ribs 70 of the lower hinge support 18 in a manner that prevents the shaft 64 of the lower terminal trunnion 48 from being removed from the slot 66 of the lower hinge support 18.

Figure 26B:
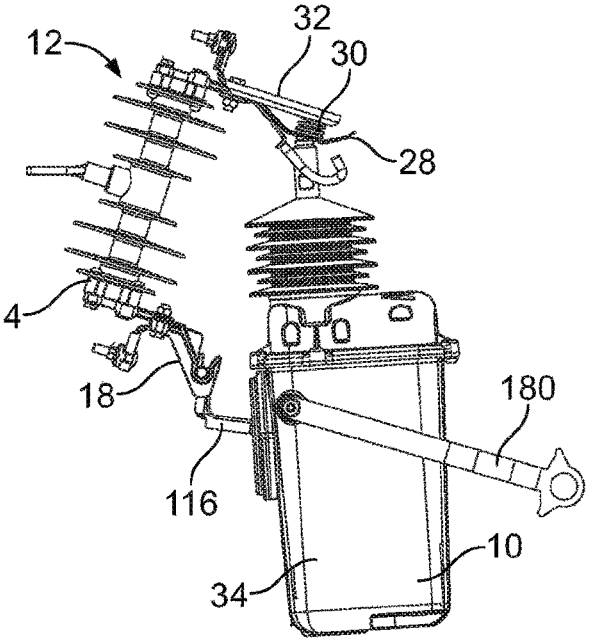
Figure 28:
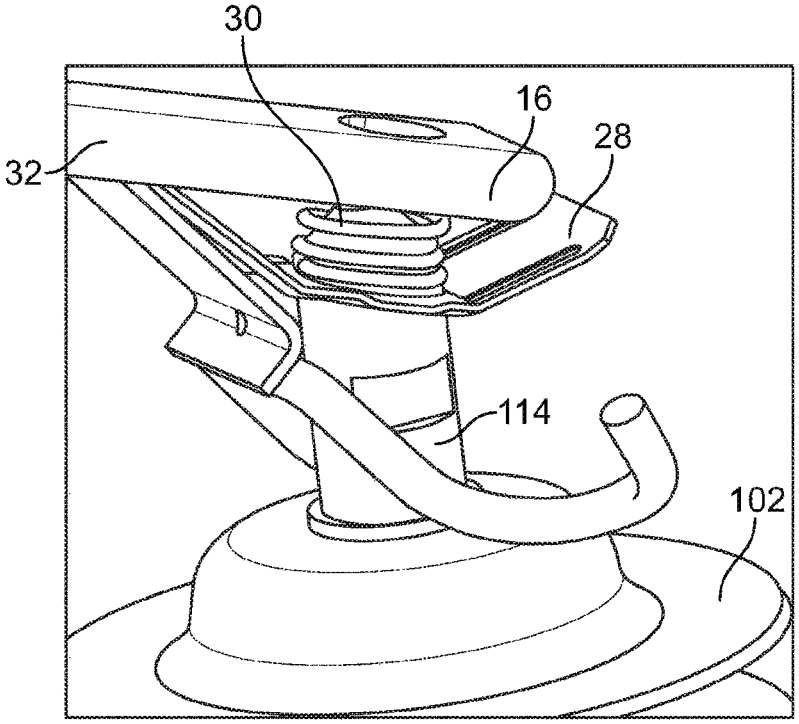
FIG. 28 illustrates a first, upper terminal of an exemplary cutout mountable recloser at least being engaged with an upper mounting bracket of a cutout.

As shown by FIG. 26B, at stage 2, the opened recloser 10 has been pivotally displaced relative to at least the cutout 12 such that the first, upper terminal 114 is engaged with the upper contact 28 of the upper mounting bracket 16. While the first, upper terminal 114 can engage the upper contact 28 in a variety of manners, as shown by at least FIG. 28, according to the illustrated embodiment, such engagement can include the first, upper terminal 114 being received in an orifice in the upper contact 28. Additionally, while the contact spring 30 can be at a variety of locations between the upper contact 28 and the upper support plate 32, according to the illustrated embodiment, the engagement of the first, upper terminal 114 with the upper contact 28 can further include at least a portion of the first, upper terminal 114 being received in an inner area of the contact spring 30.

According to certain embodiments, during, as well as up to stage 2 of installation, tension in the latch system 300, and, more specifically, at least tension on the lower terminal latch plate 302, can maintain the lower terminal latch plate 302 in the first, raised position. Further, by maintaining the lower terminal latch plate 302 in the first, raised position, the latch system 300 may also thereby maintain the second, lower terminal 116 in the first, raised position, and thereby prevent premature, or unintended, latching of the recloser 10 to the cutout 12.

Figure 26C:
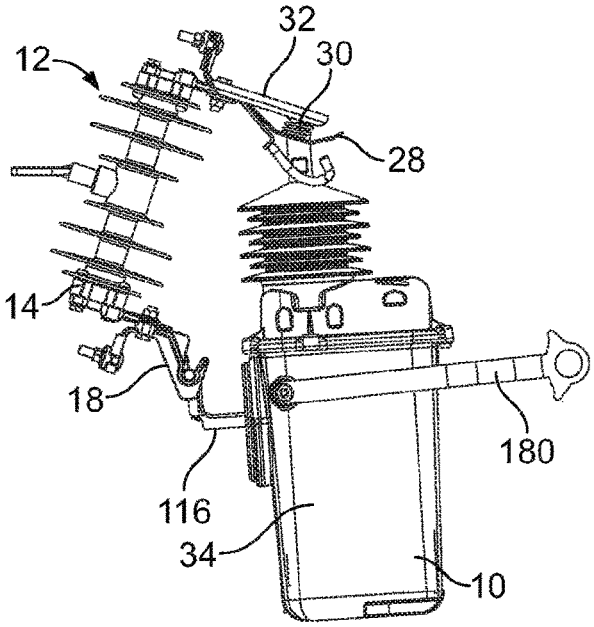

At stage 3, as shown by FIG. 26C, according to at least the illustrated relative orientations depicted in FIG. 26C, the driver 180, such as, for example, the handle, has been lifted, or rotated, in the first rotational direction (as designated by "$R_1$" in FIG. 23A). As previously discussed, such rotation of the driver 180 can, while the recloser 10 remains in the open condition, facilitate the latching system 300 lowering the lower terminal latch plate 302, thus lowering the second lower terminal 116, to their respective second, lowered positions, as well as charging the closing mechanism 108.

With respect to the latching system 300, as previously discussed, according to the illustrated embodiment, the rotation of the driver 180 in the first rotational direction can facilitate the latch release brackets 324 contacting, as well as providing a force against, against an upper portion of the plate portion 306 of the lower terminal latch plate 302 such that the lower terminal latch plate 302 is rotated in the first rotational direction to its corresponding the second, lowered positions. As also previously mentioned, according to certain embodiments, the lower terminal latch plate 302 can remain at the second, lowered position by at least a latching engagement with the lower terminal latch 304, which can, at least when the lower terminal latch plate 302 is displaced to the second, lowered position, be biased into the latching engagement with the lower terminal latch plate 302 via a mechanical biasing element, such as, for example, a torsion spring. Further, again, such latching of the lower terminal latch 304 to the lower terminal latch plate 302 can include latch bodies 312 of the lower terminal latch 304 being received in apertures 310 in the plate portion 306 of the lower terminal latch plate 302.

As previously discussed, the downward rotational displacement of the lower terminal latch plate 302 can result similar downward rotational displacement of the second, lower terminal 116. Moreover, as the second, lower terminal 116 is rotated in the first rotational direction to the second, lowered position of the second, lower terminal 116, a linear distance between at least the first, upper terminal 114 and the second, lower terminal 116 increases. Such an increase in distance between the first and second terminals 114, 116 can increase, and/or result in, an outward force being exerted by the recloser 10 against the upper mounting bracket 16 and the lower hinge support 18. Such a force can result in at least the compression of the contact spring 30 between the upper contact 28 and the upper support plate 32. Moreover, as the linear distance between at least the first, upper terminal 114 and the second, lower terminal 116 increases, the tension force exerted by the cutout 12 on the recloser 10, via, for example, the upper mounting bracket 16, including the compressed contact spring 30, and the lower hinge support 18, increases such that the recloser 10 is latched to the cutout 12, and the recloser 10 is thus generally lockingly secured to the cutout 12.

Additionally, as the driver 180, which is operably coupled to one or more linkage systems 152 of the recloser 10, is rotated in the first rotational direction during stage 3, and the current interrupter 102 is open, the driving fork 156 is also rotated in the first rotational direction (as indicated by "$R_1$" in FIG. 8), and the third leg 176*c* of the driving fork 156 thereby lifts the link guide 158. For example, with respect to the orientation of the linkage system 152 depicted in FIG. 8, rotational displacement of the driver 180 in the first, counterclockwise or rotational direction with a force sufficient to overcome at least the biasing force of the secondary mechanical biasing element 182 that is coupled to the driving fork 156, among other forces, can result in the driving fork 156 similarly being rotated in the first rotational direction. As the driving fork 156 is rotated in the first rotational direction, the guide pin 186 that is coupled to the third leg 176*c* of the driving fork 156 exerts a force against the link guide 158 at or around the first slot end 196 of the elongated guide slot 194 to lift or otherwise displace the link guide 138 generally in the direction of the first attachment flange 140*a*.

As previously discussed, the link guide 158 can be rotably coupled to a first end 202 of the spring arm 160. Accordingly, such displacement of the link guide 158 in the first rotational direction via operation of the driver 180 can, with respect to the orientation depicted in FIG. 8, facilitate the rotational displacement of the spring arm 160 in the second clockwise or rotational direction (as indicated by "$R_2$" in FIG. 8) about the release bracket shaft 204, the first and second rotational directions being opposite of each other.

As the spring arm 160 is rotated about the release bracket shaft 204 (FIG. 9) in the second rotation direction, the guide body 164, which, again, can be coupled to the spring arm 160, can be displaced in a direction generally toward the arm 222 of the main bracket 170 such that a linear distance between the base 210 of the guide body 162 and the arm 222 decreases. Further, as the linear distance between the base 210 of the guide body 162 and the arm 222 decreases, the mechanical biasing element 166, such as, for example, a spring, positioned about the guide rod 212 can be compressed and/or further compressed between the opposing first and second shoulders 214, 228.

Additionally, as the driven hub 178 is rotated in the first rotational direction, the spring arm 160 can be lifted to a position at which the spring arm 160 can be lockingly engage with, or otherwise be held in a lifted position by, the close latch 168. For example, as previously discussed, according to certain embodiments, rotation of the spring arm 160 can result in the spring arm 160 being at a position at which a protrusion 290 and/or area of the spring arm 160 adjacent to the recess 288 in the spring arm 288 can lockingly engage a generally mating portion of the close latch 168, such as, for example, a portion of the close latch 168 that is adjacent to the recess 288 in the close latch 168.

Additionally, rotation of the driving fork 156 in the first rotational direction can facilitate the second leg 176*b*, which, as previously discussed is coupled to the release link 162, exerting a force against the release link 162 that can result in a portion of the release link 162 at or around a second end 238 of an elongated release slot 240 of the release link 162 coming into contact with the release pin 242 that is coupled to the release bracket 172. As also previously discussed, with at least a portion of the release link 162 at or around the second end 238 of the elongated release slot 240, the continued displacement of the driving fork 156 in the first rotational direction can result in the release pin 242 being displaced toward the first end 250 of the elongated bracket slot 248 in the closer brackets 136*a*, 136*b*, which can facilitate rotation of the release bracket 172 about the release bracket shaft 204 in the first rotational direction. Moreover, such displacement of the release pin 242, and thus the release bracket 172, can result in the lower latch member 270 being rotably displaced to a position at which, in association with the upper latch member 266 of the main bracket 170, facilities the locking the main latch 264, as shown, for example, by at least FIGS. 6 and 11. Again, with the main latch 264 locked, the main bracket 170 can be prevented from being rotably displaced to a position at which the closer body(ies) 254 engage the pushrod 106, and, moreover, the flange 262, in a manner that could facilitate displaced of the pushrod in a manner that may close the open current interrupter 102.

Accordingly, with the main bracket 170 lockingly engaged with the release bracket 172 via at least the main latch 264, and the mechanical biasing element 166 being held in a compressed or charged state, the linkage system 152 and/or the closing mechanism 108 is in the charged state. Further, when the linkage system 152 and/or the closing mechanism 108 is in the charged state, the closer body 254 can be at a first position, as shown for example by at least FIG. 11. More specifically, with the closing mechanism 108 in the charged state, the closer body 254 is at a first position at which the closer is generally in non-engagement with the pushrod 106, and moreover, is not in engagement with the flange 262 of the pushrod 106.

Figure 26D:
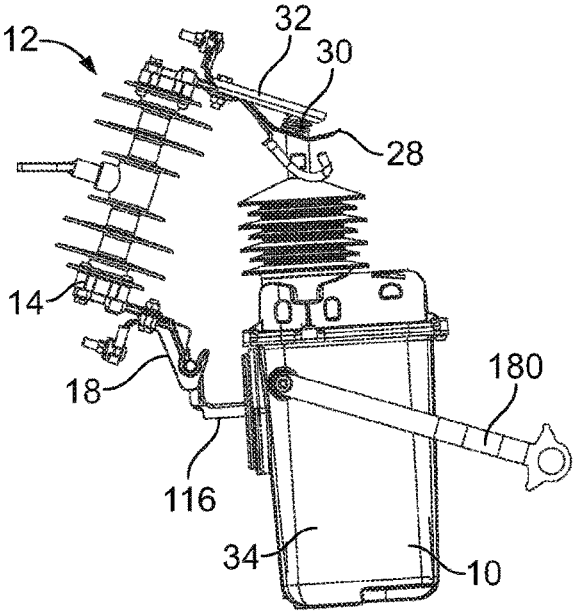

At stage 4, with the recloser 10 latched to the cutout 12, the lifted driver 180 can, via rotation of the driver 180 in the second rotational direction (as designated by "$R_2$" in FIG. 23A) be lowered to a first lowered position, as shown for example in FIG. 26D. Such displacement of the driver 180 can facilitate the closing of the opened recloser 10 after the recloser 10 has been lockingly latched to the cutout 12. More specifically, at stage 4, with the closing mechanism 108 in the charged state, and the recloser 10 in an opened condition, the driver 180 can be lowered via rotation in the second rotational direction to the first lowered position to facilitate the linkage system(s) 152 discharging the mechanical biasing element 166 such that the closer body 254 can be displaced into engagement with, as well as facilitate the displacement of, the pushrod 106 so that the pushrod 106 can be linearly displaced to a position that at least temporarily closes the current interrupter 102.

More specifically, as previously discussed, according to the illustrated embodiment, with the closing mechanism 108 in the charge state, and the driving fork 156, and at least the associated third leg 176*c*, being displaced in the second rotational direction, the guide pin 186 that is coupled to the third leg 176*c* can be displaced away from the first slot end 196 of the elongated guide slot 194. Further, according to certain embodiments, as the driving fork 156 is displaced in the second rotational direction and the guide pin 186 is traveling toward the second slot end 198 of the guide slot 194, the release link 162, via the coupling of the release link 162 to the second leg 176*b*, is displaced in direction that facilitates a portion of the release link 162 at or around second end 246 of the elongated release slot 240 contacting the release pin 242. Moreover, as the driving fork 156 continues to be rotably displaced in the second rotational direction, a portion of the release link 162 at or around the second end 246 of the elongated release slot 240 of the release link 162 can exert a force against the release pin 242 that displaces the release pin 242 toward the first end 250 of the elongated bracket slot 248 in the closer bracket 136*a*, 136*b*. Such displaced of release pin 242 by the release link 162 can facilitate rotational displacement of the release bracket 172 in the second rotational direction.

As the release bracket 172 is rotated in the second rotational direction in response to at least displacement of the release pin 242, the lower latch member 270 that extends from the release bracket 172 can be moved away from the upper latch member 266 that extends from the main bracket 170 so that the main latch 264 is unlocked. Further, according to at least certain embodiments, at or around the time the main latch 264 is unlocked, the guide pin 186 can reach a position at or generally around the second slot end 198 of the guide slot 194 in the link guide 158.

With the main latch 264 unlocked, the main latch 264 may no longer prohibit operable rotational displacement of the main bracket 170. Thus, according to the illustrated embodiment, at or around the time that the main latch 264 is unlocked, the mechanical biasing element 166 can be discharged, and the main bracket 170 can begin to be relatively rapidly displaced via a force(s) provided by at least the release of the stored energy of the previously charged mechanical biasing element 166. Accordingly, as the main bracket 170 is displaced, the closer body 254 is displaced from the first position, at which the closer body 254 is not engaged with the pushrod 106, to an intermediate position at which the closer body 254 at least comes into contact with the pushrod 106. As previously discussed, according to certain embodiments, such engagement or contact can occur between the contact surface(s) 260 of the closer body(ies) 254 and a generally outwardly extending flange 262 of the pushrod 106. As the main bracket 170 continues to be displaced to the above-discussed second position of the closer body(ies) 254, the engagement and/or contact between the closer body(ies) 254 and the pushrod 106 can facilitate the displacement of the pushrod 106 to a position that facilitates the at least temporary closing of the current interrupter 102. For example, according to certain embodiments, when the closer body 254 has reached the second position, as shown for example in FIG. 18, the pushrod 106 may have been displaced to a position that results in the moveable contact 112 being electrically coupled to the fixed contact 110 such that the current interrupter 102 is closed. Accordingly, rather than being closed by an electromagnet actuator, the discharging of the charged closing mechanism 108 can result in a mechanical closing of a current interrupter 102 via the application of released stored energy from the closing mechanism 108 to displace an otherwise magnetically displaceable pushrod 106.

With the current interrupter 102 being closed via the operation of the closing mechanism 108, current may again flow through the recloser 10. Further, such a supply of primary power through the recloser 10 may also provide power that can be stored by the electronics of the recloser 10, including, for example, the electromagnetic actuator 104, for subsequent operation of the electromagnetic actuator 104.

However, in at least certain situations, following the mechanical closing of the recloser 10, an existing or new fault current may result in the recloser 10 being opened in a relatively short time period after the recloser 10 had been closed by operation of the closing mechanism 108. Such relatively rapid reopening of the recloser 10 can be facilitated by the subsequent operation of the electromagnetic actuator 104. Accordingly, the closing mechanism 108 can also be configured to, after discharging of the closing mechanism 108 and associated displacement of the closer body(ies) 254 to the second position, relatively rapidly displace at least the closer body 254 and/or the main bracket 170, among other portions of the closing mechanism 108, to a position(s) such that the closing mechanism 108 does not interfere with any subsequent re-opening of the current interrupter 102 by operation of the electromagnetic actuator 104.

Therefore, as previously discussed, as the main bracket 170 is being displaced during discharging of the closing mechanism 108, the closer fastener 258 is also displaced such that a sliding engagement between the closer fastener 258 and the secondary release lever 154 facilitates the rotational displacement of the secondary latch lever 154 in the first rotational direction. As the secondary latch lever 154 is coupled to the lever spindle 280, which is also coupled to the close latch 168, such rotation of the secondary latch lever 154 is translated, via the lever spindle 280, to the close latch 168. Accordingly, such rotation of the secondary latch lever 154 via engagement with the closer fastener 258 results in the close latch 168 also being rotably displaced in the second rotational direction.

As the close latch 168 is rotated in the second rotational direction, the close latch 168 is disengaged from the locking engagement with the spring arm 160. Further, as the spring arm 160 is coupled to the guide body 164, with the spring arm 160 unlatched from the close latch 168, the spring arm 160 is able to, with respect to the linkage system 152 orientation depicted in FIG. 8, be rotably displaced in the first rotational direction. According to certain embodiments, such rotation of the spring arm 160 can be added, for example, at least in part, by the biasing force provided by the mechanical biasing element 166, among other forces. Further, such displacement of at least the spring arm 160 can increase the linear distance between the arm 222 of the main bracket 170 and the base 210 of the guide body 164, and, moreover, the distance between the associated first and second shoulders 214, 228, thereby further relieving the pressure or force being exerted by the mechanical biasing element 166.

According to certain embodiments, the timing of the release of the spring arm 160 from locking engagement with the close latch 168 can generally coincide with, or be shortly after, the closer body 254 reaching, via discharging of at least the mechanical biasing element 166, the second position and/or the pushrod 106, via operation of the closing mechanism 108, closing the current interrupter 102. Accordingly, with the force or pressure of the mechanical biasing element 166 being reduced and/or relieved and the pushrod 106 positioned for the current interrupter to be, or have been, closed, the secondary mechanical biasing element(s) 183 that is/are coupled to main bracket 170 and another portion of the closing mechanism 108 can exert a force that displaces at least the main bracket 170 to a position that can prevent or minimize the ability of the closer body(ies) 254 to interfere with the subsequent displacement, if any, of the pushrod 106 that may be associated with the electromagnetic actuator 104 re-opening the current interrupter 102. For example, according to the illustrated embodiment, the secondary mechanical biasing element(s) 183 that is/are coupled to both the arm 222 of the main bracket 170 and a portion of the pin can, at or around the timing of the closing of the current interrupter 102 via operation of the closing mechanism 108 and associated mechanical displacement of the pushrod 106, exert a force on the main bracket 170 that displaces the closer body(ies) 254 away from the second position of the closer body(ies) 254 and toward, or to, the first position of the closer body(ies) 254. The closing mechanism 108 may then be at the discharged state or condition, as show, for example, in at least FIGS. 8 and 14.

Additionally, during normal operation of the recloser 10 and/or the associated electrical power system, the closing mechanism 108 may remain in the discharged state while the recloser 10 remains latched to the cutout 12, as shown, for example, by at least FIG. 26D. In the event the recloser 10 is to again be manually closed via operation of the closing mechanism 108, such as, for example, in the event insufficient electrical power is available for the recloser 10 to be closed via operation of the electromagnetic actuator 104, the driver 180 can again be raised via rotation of the driver 180 in the first rotational direction. For example, the driver 180 can be raised from the first lowered position shown in FIG. 26D, to the raised position shown in FIG. 26C to again charge the closing mechanism 108. The driver 180 can then subsequently be rotated in the second rotational direction, such as, for example, being lowered from the raised position shown in FIG. 26C back to the first lowered shown in FIG. 26D. Such rotation of the driver 180 back to the first lowered position can discharge of the charged closing mechanism 108 to facilitate mechanical displacement of the pushrod 106 in a direction that closes the current interrupter 102, as previously discussed. Further, such re-charging and subsequent discharging of the closing mechanism 108 can occur while the recloser 10 remains latched to the cutout 12. Additionally, for at least purposes of safety, in at least certain embodiments or situations, such recharging of the closing mechanism 108 can also occur after at least the procedure for manually opening the recloser 10, as previously discussed and as also discussed below, has been completed.

As indicated by the foregoing example, such re-charging and subsequent discharging of the closing mechanism 108, and associated mechanical closing of the recloser 10, can occur while the recloser 10 remains latched to the cutout 12. Further, despite the occurrence of an event(s) that had resulted in the recloser 10 being opened, as well as the inability of the recloser 10 to be closed via operation of the electromagnetic actuator 104, the recloser 10 remains latched to the cutout 12, such as, for example, at a position shown by at least FIG. 26D. Moreover, according to the illustrated embodiment, the recloser 10 is configured to be unlatched from the cutout 12 via actions performed by an operator, and not necessarily in response to a fault condition or opening of the recloser 10.

Figure 26E:
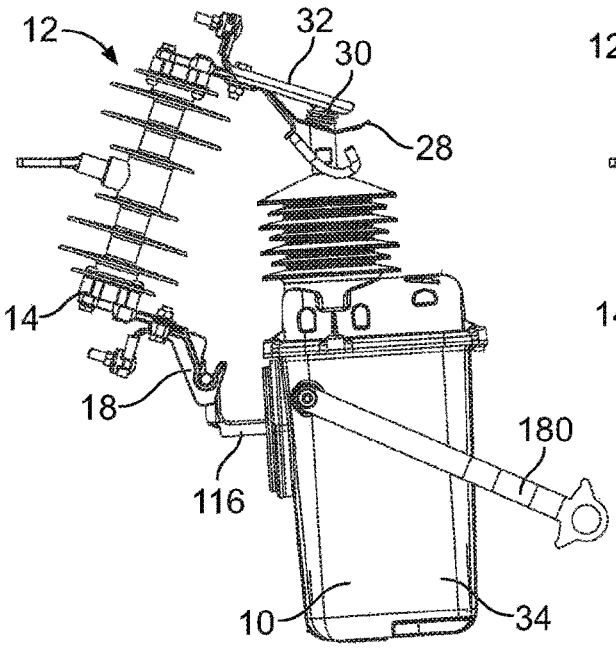

Accordingly, regardless of whether the recloser 10 is closed or is locked in an open condition, the recloser 10 is configured for unlatching from the cutout 12 via manipulation of the driver 180 by an operator or other individual. For example, at stage 5, as indicated by FIG. 26E, the recloser 10 can be manually opened by further rotation of the driver 180 in the second rotational direction from the first lower position, as shown in FIG. 26D, to a second lower position of the driver 180, the second lower position being lower than the first lower position. As previously discussed, such rotation can facilitate the latch release bracket(s) 324 exerting a force against at least a portion of the pushrod 106 that can facilitate an increase in a distance between components of the electromagnetic actuator 104 that are being subjected to an attractive magnetic force, and thereby reduce the strength of the attractive magnetic force being exerted on those components. Further, as previously discussed, such a reduction in such attractive magnetic forces can allow other biasing forces by other components of the recloser 10, pushrod 106, and/or electromagnetic actuator 104, to overcome those attractive magnetic forces and thereby provide other biasing forces that further displace the pushrod 106 to a position that opens the current interrupter 102.

Figure 26F:
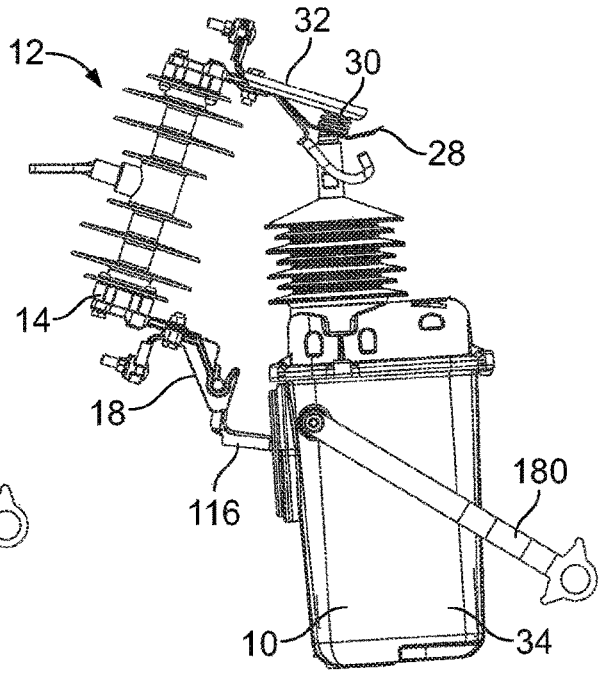

At step 6, as shown by FIG. 26F, with the recloser 10 safely in the opened by the manual opening of the current interrupter 102, the driver 180 can continue to be displaced in the second rotational direction from the second lower position, as shown in FIG. 26E, to a third lower position of the driver 180 as shown in FIG. 26F, the third lower position being lower than the second lower position. As previously discussed, such continued rotational displacement of the driver 180 in the second rotational direction can facilitate the latch release bracket 324 contacting, and rotating at least, the adjacent lever portion 328 of the latch arm 326 of the lower terminal latch 304 so as to facilitate rotation the lower terminal latch 304 away from the latching engagement with the lower terminal latch plate 302. With the lower terminal latch plate 302 unlatched from the lower terminal latch 304, the lower terminal latch plate 302 can be rotated back from the second, lowered position to the first, raised position, such as, for example, via mechanical biasing forces and/or gravitational forces associated with at least the weight of the recloser 10.

Further, as previously discussed, as the second, lower terminal 116 is coupled to the lower terminal latch plate 302, the second, lower terminal 116 can also be raised to its first, raised position with the raising of the lower terminal latch plate 302 to the first, raised position. Such raising of the second, lower terminal 116 can result in a reduction of forces being exerted between recloser 10 and the cutout 12, such that the recloser 10 is unlatched from the cutout 12. For example, with the second, lower terminal 116 at its first, raised position, as shown for example in FIG. 26F, a linear distance between the first, upper terminal 114 and the second, lower terminal 116 has been reduced such that the generally outwardly force(s) exerted against the cutout 12 by the recloser 10, such as, for example, against the upper mounting bracket 16 and the lower hinge support 18, is/are reduced. Moreover, the tension forces exerted by the cutout 12 can be reduced with the raising of the second, lower terminal 116 and the associated decrease in the linear distance between the first and second terminals 114, 116. Further, such a reduction in the force(s) exerted between the cutout 12 by the recloser 10 can result in the at least partial decompression of the contact spring 30.

Figure 26G:
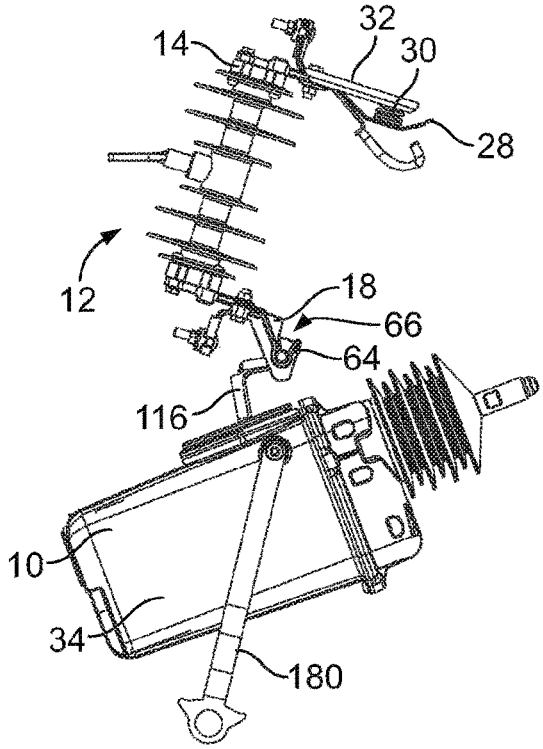

With the recloser 10 opened and unlatched from the cutout 12, at stage 7, as shown by FIG. 26G, the recloser 12 can be disengaged from the upper contact 28, and rotated relative to the cutout 12. For example, at stage 7, an operator or other individual can grasp at least a portion of the recloser 10 so as to manipulate the recloser 10 from the position shown in FIG. 26F to the hanging position shown in FIG. 26G. Such relative rotation of the recloser 10 can also facilitate rotation of the shaft 64 of the second, lower terminal 116 about the slot 66 of the lower hinge support 18 to disengage any locking engagement therebetween. The recloser 10 can then be lifted such that the shaft 10 is removed from the slot 66, and the recloser 10 is thus detached from the cutout 12.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. A cutout mountable recloser comprising:

a first terminal;

a recloser assembly electrically coupled to the first terminal, the recloser assembly comprising a current interrupter, an electromagnetic actuator, and a pushrod;

a latch system coupled to the recloser assembly, the latch system comprising a lower terminal latch plate, the lower terminal latch plate pivotally displaceable between a first, raised position and a second, lowered position; and a second terminal coupled to the lower terminal latch plate, the second terminal being pivotally displaceable between a raised position and a lowered position by the pivotable displacement of the lower terminal latch plate between the first, raised position and the second, lowered position, wherein the second terminal is electrically coupled to the recloser assembly and is separated from the first terminal by a first linear distance when the second terminal is in the raised position, and by a second linear distance when the second terminal is in the lowered position, the first linear distance being smaller than the second linear distance.

2. The cutout mountable recloser of claim 1, wherein the latch system further includes a lower terminal latch, the lower terminal latch being biased for a latching engagement with the lower terminal latch plate at the second, lowered position in a manner that secures the lower terminal latch plate at the second, lowered position.

3. The cutout mountable recloser of claim 2, wherein the latch system further includes at least one latch release bracket pivotally secured to at least a portion of the recloser assembly, the at least one latch release bracket being rotatable in a first rotational direction and a second rotational direction, the at least one latch release bracket structured to contact and transmit a force to the lower terminal latch plate that displaces the lower terminal latch plate from the first, raised position to the second, lowered position as the at least one release bracket is rotated in the first rotational direction.

4. The cutout mountable recloser of claim 3, wherein the lower terminal latch includes at least one latch arm, the at least one latch release bracket being structured to contact and transmit a force to the at least one latch arm as the at least one release bracket is rotated in the second rotational direction that releases the lower terminal latch from the latching engagement with the lower terminal latch plate at least when the lower terminal latch plate is at the second, lowered position.

5. The cutout mountable recloser of claim 4, wherein the at least one latch release bracket includes an upper portion that is positioned to exert a force against a portion of the pushrod as the at least one release bracket is rotated in the second rotational direction that displaces the pushrod in a direction away from a pushrod closed position of the pushrod, the current interrupter being in an electrically closed condition when the pushrod is at the pushrod closed position.

6. The cutout mountable recloser of claim 1, further including a lower terminal gasket structured to provide a seal about an opening of a housing of the cutout mountable recloser and about at least a portion of the second terminal, the lower terminal gasket being flexibly adjustable to adjust to displacement of the second terminal between the raised position and the lowered position, and wherein at least a portion of the recloser assembly is housed in the housing.

7. The cutout mountable recloser of claim 1, wherein the recloser assembly further includes a closing mechanism having at least one closer body and at least one mechanical biasing element, the closing mechanism being selectively dischargeable from a charged state to a discharged state, wherein the at least one mechanical biasing element is charged and the at least one closer body is disengaged from the pushrod when the closing mechanism is in the charged state, and wherein the at least one mechanical biasing element is discharged to provide a force that displaces the at least one closer body into contact with the pushrod and displaces the pushrod from an open position to a closed position when the closing mechanism is discharged to the discharged state, the current interrupter being electrically opened when the pushrod is at the open position and electrically closed when the pushrod is at the closed position.

8. The cutout mountable recloser of claim 1, wherein the second terminal comprises a lower main terminal and a lower terminal trunnion, the lower terminal trunnion being selectively detachable from the lower main terminal, and wherein the lower main terminal is coupled to the lower terminal latch plate.

9. The cutout mountable recloser of claim 1, further comprising a housing and a driver, at least a portion of the recloser assembly housed in the housing, the driver being coupled to the latch system, at least a portion of the driver being external to the housing, wherein, in response to selective rotation of the driver, the latch system rotates the lower terminal latch plate toward at least one of the first, raised position and the second lowered position.

10. A recloser structured for a selectively releasable latching engagement with a cutout, the recloser comprising:

a driver, a first terminal;

a recloser assembly electrically coupled to the first terminal and coupled to the driver, the recloser assembly comprising a current interrupter, a pushrod, an electromagnetic actuator, and a closing mechanism, the closing mechanism having at least one closer body and at least one mechanical biasing element, the at least one mechanical biasing element releasing a force, when the closing mechanism is discharged from a charged state to a discharged state, that displaces the at least one closer body into a moving engagement with the pushrod, the moving engagement displacing the pushrod to a position that electrically closes the current interrupter;

a latch system coupled to the driver, the latch system having a lower terminal latch plate that is pivotally displaceable in between a first, raised position and a second, lowered position; and a second terminal coupled to the lower terminal latch plate and electrically coupled to at least the recloser assembly, the second terminal being pivotally displaceable between a raised position and a lowered position by the pivotable displacement of the lower terminal latch plate between the first, raised position and the second, lowered position.

11. The recloser of claim 10, wherein, in response to rotation of the driver in a first rotational direction, the closing mechanism is structured to be in the charged state, and the lower terminal latch plate is displaced to the second, lowered position, the second terminal being separated from the first terminal by a first linear distance when the lower terminal latch plate is at the second, lowered position.

12. The recloser of claim 11, wherein the driver is structured to be rotably displaced in a second rotational direction to a first position, wherein the closing mechanism is structured to be discharged to the discharged state by the driver being rotated to the first position.

13. The recloser of claim 12, wherein the driver is structured to be further rotably displaced in the second rotational direction from the first position to a second position, and wherein the latch system includes at least one latch release bracket that is structured to be rotated, in response to rotation of the driver to the second position, into a moving engagement with the pushrod that displaces the pushrod in a direction away from the current interrupter.

14. The recloser of claim 13, wherein the driver is structured to be further rotably displaced in the second rotational direction from the second position to a third position, and the at least one latch release bracket is structured, in response to rotation of the driver to the third position, be displaced into moving engagement with at least another portion of the latch system that releases the lower terminal latch plate from the second, lowered position to the first, raised position, the second terminal being separated from the first terminal by a second linear distance when the lower terminal latch plate is at the first, raised position, the second linear distance being smaller than the first linear distance.

15. A method comprising:

rotably coupling a second terminal of a recloser to a lower hinge support of a cutout, the recloser including an electromagnetic actuator;

rotating a first terminal of the recloser into engagement with an upper contact of an upper mounting bracket of the cutout;

latching, by selectively increasing a linear distance between the first terminal and the second terminal via at least rotation of a driver of the recloser in a first rotational direction, the recloser to the cutout;

unlatching, by selectively decreasing the linear distance between the first terminal and the second terminal via at least rotation of the driver in a second rotational direction, the recloser from the cutout; and rotably displacing, after unlatching the recloser, the first terminal from the upper contact.

16. The method of claim 15, wherein the recloser is in an electrically opened condition during each of at least the rotatable coupling of the second terminal to the lower hinge support, rotation of the first terminal into engagement with the upper contact, and the latching of the recloser to the cutout.

17. The method of claim 16, further including the step of closing the recloser after latching the recloser to the cutout.

18. The method of claim 17, wherein the step of closing the recloser includes discharging a closing mechanism of the recloser from a charged state to a discharged state, the discharging of the closing mechanism including releasing a stored energy from at least one mechanical biasing element that facilitates a moving engagement of at least one closer body of the closing mechanism with a pushrod of the recloser to mechanically displace the pushrod to a position that closes a current interrupter of the recloser.

19. The method of claim 18, wherein the step of latching the recloser to the cutout includes:

displacing, by rotation of the driver, at least one release bracket in a first rotational direction;

displacing, by a force transmitted from the at least one release bracket as the at least one release bracket is rotated in the first rotational direction, a lower terminal latch plate of a latch system of the recloser from a first, raised position to a second, lowered position, the second terminal being connected to the lower terminal latch plate; and securely latching the displaced lower terminal latch plate at the second, lowered position.

20. The method of claim 19, the step of unlatching the recloser to the cutout includes:

displacing, via rotation of the driver, the at least one release bracket in a second rotational direction, the second rotational direction being opposite of the first rotational direction;

displacing, by a force transmitted from the at least one release bracket as the at least one release bracket is rotated in the second rotational direction, a lower terminal latch of the latch system;

unlatching, in response to the displacement of the lower terminal latch, the lower terminal latch plate from the second, lowered position;

displacing, after the unlatching of the lower terminal latch plate, the lower terminal latch plate to the first, raised position.

21. The method of claim 15, wherein the step of latching the recloser to the cutout includes increasing a tension force exerted by the cutout on the recloser in response to the increase in the linear distance between the first terminal and the second terminal.

22. The method of claim 21, wherein the step of unlatching the recloser to the cutout includes decreasing the tension force exerted by the cutout on the recloser in response to the decrease in the linear distance between the first terminal and the second terminal.

* * * * *